US008716988B2

(12) United States Patent
Yabuzaki et al.

(10) Patent No.: US 8,716,988 B2
(45) Date of Patent: May 6, 2014

(54) POWER FACTOR CORRECTION TYPE SWITCHING POWER SUPPLY UNIT

(75) Inventors: Jun Yabuzaki, Matsumoto (JP); Jian Chen, Matsumoto (JP)

(73) Assignee: Fuji Electric Co., Ltd., Kawasaki-Shi (JP)

( * ) Notice: Subject to any disclaimer, the term of this patent is extended or adjusted under 35 U.S.C. 154(b) by 769 days.

(21) Appl. No.: 12/942,192

(22) Filed: Nov. 9, 2010

(65) Prior Publication Data

US 2011/0109281 A1 May 12, 2011

(30) Foreign Application Priority Data

Nov. 10, 2009 (JP) ..... 2009-257405

(51) Int. Cl.
*G05F 1/00* (2006.01)

(52) U.S. Cl.
USPC ..... 323/266; 323/283

(58) Field of Classification Search
USPC ..... 323/234, 237, 265, 266, 282, 284, 285, 323/299, 300, 283; 363/50, 55, 363/56.01–56.03, 56.05, 95, 97, 124, 131
See application file for complete search history.

(56) References Cited

U.S. PATENT DOCUMENTS 6,326,771 B1 * 12/2001 Popescu-Stanesti ..... 320/139
6,980,445 B2 * 12/2005 Fukumoto et al. ..... 363/45
8,085,021 B2 * 12/2011 Chen et al. ..... 323/282
2002/0089860 A1 7/2002 Kashima et al.
2007/0253223 A1 11/2007 Neidorff et al.
2009/0116265 A1 * 5/2009 Saji ..... 363/37
2009/0190377 A1 * 7/2009 Wang et al. ..... 363/21.1
2011/0019322 A1 1/2011 Akama
2011/0109281 A1 5/2011 Yabuzaki et al.
2011/0122664 A1 5/2011 Yabuzaki et al.

FOREIGN PATENT DOCUMENTS

JP 07-007953 A 1/1995
JP 11-113251 A 4/1999
JP 11252908 A 9/1999
JP 2002-176768 A 6/2002
JP 2003219635 A 7/2003
JP 2004-166440 A 6/2004
JP 2006-217695 A 8/2006

* cited by examiner

*Primary Examiner* — Adolf Berhane
*Assistant Examiner* — Jeffrey Gblende
(74) *Attorney, Agent, or Firm* — Rossi, Kimms & McDowell LLP

(57) ABSTRACT

A multiplier multiplies a current signal of an Iy generator and a voltage signal from a Vx generator corresponding to a divided voltage value of an output voltage of a full-wave rectifier. The result of the multiplication is output as a current reference signal to the non-inversion input terminal of a current error amplifier. A current peak waveform generator circuit generates an envelope waveform of peak values of an inductor current. An Iz generator, when the envelope waveform exceeds a first threshold value smaller than a third threshold value set in an overcurrent protection circuit, curbs the inductor current by adjusting the size of a current signal output to the multiplier, and reducing the current reference signal.

12 Claims, 18 Drawing Sheets

16 Iy Generator
18 Vx Generator
20s Iz Generator
22 Multiplier
25 Inversion Amplifier Circut
30 Overcurrent Protection Circut
50 Current Peak Waveform Generator Circut 16 Iy Generator
18 Vx Generator
20s Iz Generator
22 Multiplier
25 Inversion Amplifier Circut
30 Overcurrent Protection Circut
50 Current Peak Waveform Generator Circut 16 Iy Generator
18 Vx Generator
22 Multiplier
25 Inversion Amplifier Circut
40 Overvoltage Protection Circut
60 Soft-Stop Overvoltage Protection Circut

POWER FACTOR CORRECTION TYPE SWITCHING POWER SUPPLY UNIT

BACKGROUND OF THE INVENTION

1. Technical Field

The present invention relates to a switching power supply that converts from an alternating current to a direct current, and in particular to a power factor correction type switching power supply unit that improves a power factor.

2. Related Art

In recent years, a switching power supply unit that has an alternating current voltage as an input has been widely utilized in electronic instruments. This kind of switching power supply unit being one which, by causing a switching operation of a switching element linking an input and an output, converts a full-wave rectified alternating current input voltage into a direct current output voltage of a desired size, and supplies it to a load, for example, the one described in JP-A-2002-176768 (refer to, in that reference, paragraphs [0045] to [0056], FIGS. 7, 8, and the like), to be described hereafter, is known.

FIG. 14 is a circuit diagram showing one example of a heretofore known power factor correction type switching power supply unit. Herein, a power factor correction (PFC) type switching power supply circuit that operates in continuous conduction mode is shown, and this is applied to an active filter type power supply unit.

The heretofore known power factor correction type switching power supply unit shown in FIG. 14 has a full-wave rectifier 4 that full-wave rectifies a commercial power supply 2, and its output is connected to one end of an inductor L1. The connection point of the other end of the inductor L1 and a diode D1 is connected to the drain terminal of, for example, an N-channel type MOS transistor (a metal oxide semiconductor field-effect transistor) configuring a switching element 6. The other end of the inductor L1 is connected to a load 8 via a rectifying and smoothing circuit formed of the diode D1 and a capacitor C1, and a direct current output voltage Vout is output to the load 8.

As well as the source terminal of the MOS transistor, which is the switching element 6, being connected to the ground (GND), the gate terminal is connected to an output terminal DO of a power factor correction control circuit 10A. One end of a series resistor circuit formed of resistors R1 and R2 is connected to the connection point of the full-wave rectifier 4 and inductor L1, and the other end is grounded. A multiplier input terminal VDET of the power factor correction control circuit 10A is a terminal into which a detected value of an output voltage of the full-wave rectifier 4 is input, and the connection point of the resistors R1 and R2 is connected to the multiplier input terminal VDET. Also, the full-wave rectifier 4 is grounded via a resistor R3, and the connection point of the full-wave rectifier 4 and resistor R3 is connected to an inductor current signal generating input terminal IS of the power factor correction control circuit 10A. Furthermore, a series circuit of resistors R4 and R5 is connected in parallel with the load 8, and the direct current output voltage Vout the same as that of the load 8 is applied thereto. A feedback voltage input terminal FB of the power factor correction control circuit 10A being a terminal into which a detected value of the direct current output voltage Vout is input, herein, the connection point of the resistors R4 and R5 is connected to the feedback voltage input terminal FB, and a voltage signal wherein the direct current output voltage Vout is divided by a resistor is returned here.

Next, a simple description will be given of an operation of the heretofore described heretofore known power factor correction type switching power supply unit of FIG. 14.

The heretofore known power factor correction type switching power supply unit of FIG. 14 employs a control method called an average current control method, average current mode control, or the like, and the power factor correction control circuit 10A is one that sinusoidally controls a current flowing to the alternating current commercial power supply 2 side in the same phase as that of the alternating current input voltage, while stabilizing the direct current output voltage Vout. The feedback voltage input terminal FB of the power factor correction control circuit 10A is connected to an input terminal of a voltage error amplifier 14 together with a reference voltage source 12, which sets a voltage command value for the direct current output voltage Vout. The voltage error amplifier 14 generates a voltage error signal wherein the difference between the detected value (a divided voltage value in this case) of the direct current output voltage Vout and the voltage command value of the reference voltage source 12 is amplified. Then, the voltage error signal of the voltage error amplifier 14 is input into an Iy generator 16, and converted into a current signal Iy indicating a voltage error.

In the power factor correction control circuit 10A, its multiplier input terminal VDET being connected to a Vx generator 18 (a voltage to voltage converter circuit), the detected value (a divided voltage value in this case) of the output voltage of the full-wave rectifier 4 is input into the Vx generator 18, and converted into a voltage signal Vx. However, the Vx generator 18, being shown for the sake of a comparison with a power factor correction control circuit 10As in an embodiment to be described hereafter, is a simple wiring linking an input terminal and output terminal, and the voltage signal Vx is equivalent to the voltage of the multiplier input terminal VDET. Also, a constant voltage signal Vbias generated by an unshown circuit is input into an Iz generator 20, and converted into a current signal Iz.

The multiplier 22 multiplies the current signal Iy of the Iy generator 16 and the voltage signal Vx corresponding to the detected value of the output voltage of the full-wave rectifier 4, and makes this the value of a current command to a current error amplifier 24. An inductor current signal, wherein a voltage signal, which is an inductor current $I_L$ input via the inductor current signal generating input terminal IS and voltage converted in the current detecting resistor R3, is further inversion amplified in an inversion amplifier circuit 25, is input into the current error amplifier 24, along with an output signal Vmul of the multiplier 22, which is the current command value. A sawtooth wave or triangular wave carrier signal of a constant frequency that determines a switching cycle is generated in an oscillator circuit (OSC) 26, and input into a PWM comparator 28. In the PWM comparator 28 into which the carrier signal and the current error signal are input, the magnitudes of the signals are compared, a pulse width modulation (PWM) control signal is generated, and this is applied to the gate terminal of the switching element 6 via an AND circuit 32 and driver circuit 34.

Herein, an overcurrent protection (OCP) circuit 30 is connected to the inversion amplifier circuit 25, and limits the maximum value of the inductor current $I_L$. Herein, when an inductor current exceeding a predetermined threshold value flows, an overcurrent limit signal L (Low) is input into the AND circuit 32, and the output of the AND circuit 32 compulsorily becomes L. As a switching signal is output to the output terminal DO of the power factor correction control circuit 10A from the AND circuit 32 via the driver circuit 34, the switching element 6 is turned off on the output of the AND circuit 32 becoming L. By controlling the on-off timing of the switching element 6 in this way, it is possible to control the value of a current flowing to the capacitor C1 via the diode D1. Actually, in the voltage error amplifier 14 and current error amplifier 24, a feedback constant setting circuit is connected between the input and output terminals, but a depiction of both feedback constant setting circuits is omitted from FIG. 14.

A power factor control circuit shown in FIGS. 7 and 8 of JP-A-2002-176768, and a self-exciting type power supply circuit using it, employ the heretofore described method called the average current control method, average current mode control, or the like. Also, a description is also given in JP-A-2002-176768 of a heretofore known overcurrent protection (OCP) and overvoltage protection (OVP).

However, in a power factor correction type switching power supply unit in which the switching frequency is fixed, the maximum value of the inductor current $I_L$ flowing through the inductor L1 is limited by the overcurrent protection (OCP) function. Herein, the overcurrent protection (OCP) function operates at a start-up time or a time of an excessive load, and a control is carried out in such a way that the inductor current does not exceed the tolerated maximum value. On a condition arising wherein the on duty (the on time ratio) of a pulse signal supplied to the switching element 6 in this condition exceeds 50%, it may happen that a sub-harmonic oscillation (a phenomenon wherein the on duty of the switching element 6 is unstable and wavers) occurs.

FIG. 15 is a timing diagram showing a signal waveform illustrating a sub-harmonic oscillation occurring when the OCP function operates at a switching element on duty of 50% or higher.

As shown in FIG. 15, when limiting the peak value of the inductor current $I_L$ at an OCP threshold value Is, although the angle of inclination of the current rise in an on period Ton, and the angle of inclination of the current fall in an off period Toff, do not change in switching periods T1 to T4, the ratio (on duty) of the on period Ton and off period Toff changes. This kind of phenomenon is called a sub-harmonic oscillation, and when the sub-harmonic oscillation occurs, it may happen that a load current becomes unstable. Also, when the sub-harmonic oscillation is occurring, it may happen that a ripple voltage included in the output voltage increases, or that a current change enters an audible region of 20 kHz or lower, and these are seen as a squeaking problem.

Although limiting a peak current is also effective in preventing a saturation of the inductor, there is a problem in that the heretofore described sub-harmonic oscillation cannot be avoided.

Also, as another protective function of the power factor correction type switching power supply unit, it is conceivable, by using an overvoltage protection circuit having the heretofore described overvoltage protection (OVP) function, to protect in such a way that the output voltage does not exceed the tolerable voltage of the load 8 for any reason.

FIG. 16 is a circuit diagram showing another example of the heretofore known power factor correction type switching power supply unit, this one including an overvoltage protection circuit, and FIGS. 17A and 17B are timing diagrams showing a signal waveform for overvoltage protection at a start-up time of the heretofore known power factor correction type switching power supply unit shown in FIG. 16. In the power factor correction control circuit 10B of FIG. 16, parts corresponding to those of the power factor correction control circuit 10A of FIG. 14 are shown with the same reference numerals and characters.

The heretofore known overvoltage protection circuit, on a load fluctuation or AC input voltage fluctuation occurring, and the output voltage or input voltage becoming excessive, causes the overvoltage protection (OVP) function using the overvoltage protection circuit to operate for the switching element, causing the switching element switching operation to stop completely (the switching element is turned off) after a time, or instantly. The power factor correction control circuit 10B of FIG. 16 is an example wherein the overvoltage protection circuit 40 carries out an overvoltage protection with respect to the output voltage. For example, after the start-up is started at a time t1, on a feedback voltage to the feedback voltage input terminal FB reaching a threshold voltage Vth of the overvoltage protection circuit 40 at a time t2, as shown in FIG. 17B, the switching element 6 stops operating. In this kind of case, the current flowing through the inductor L1 rapidly becomes zero, after which a resonance between the inductor L1 and a parasitic capacitor of the switching element 6 starts, and the kind of resonance current shown in FIG. 17A flows.

On the change of the resonance current at this time entering the audible region of 20 kHz or lower, it is seen as the same kind of squeaking problem as in the power factor correction control circuit 10A of FIG. 14 in the power factor correction control circuit 10B of FIG. 16 too.

FIGS. 18A and 18B are timing diagrams showing a signal waveform at a time of a cancellation of the overvoltage protection. As shown in the diagram, on the direct current output voltage Vout that exceeds a threshold value Vth1 at a timing t2 subsequently reaching a timing t3 at which it drops as far as a cancellation voltage Vth0 of the overvoltage protection (OVP), the stopped condition of the switching element 6 is cancelled, and the switching is restarted. In this case too, depending on the output voltage from the voltage error amplifier 14, it may happen that a large current flows through the inductor L1. Then, there is a problem in that a squeaking occurs due to a large current suddenly starting to flow through the inductor L1.

When carrying out a peak current limitation using the overcurrent protection (OCP), it is a cause of a sub-harmonic oscillation occurring, bringing about a squeaking. Also, as a squeaking due to a resonance current also occurs when stopping the switching element 6 using the overvoltage protection (OVP) function, a squeaking also occurs at a time of restarting after stopping the switching operation. That is, although the overvoltage protection (OVP) function stopping the switching element 6 is effective from the point of view of curbing a sudden rise of the output voltage, it is difficult to avoid the occurrence of an accompanying squeaking.

SUMMARY OF THE INVENTION

The invention, having been contrived bearing in mind the above-discussed points, has an object of providing a power factor correction type switching power supply unit having an overcurrent protection (OCP) function and overvoltage protection (OVP) function that can curb or minimize the occurrence of squeaking.

According to one aspect of the invention, in order to solve the heretofore described problems, there is provided a power factor correction type switching power supply unit that, based on an alternating current input voltage full-wave rectified in a diode bridge, supplies a direct current output voltage of a step-up type converter having an inductor, a switching element, and an output capacitor to a load.

The power factor correction type switching power supply unit includes a multiplier that carries out a multiplication of a voltage error signal, wherein the difference between a detected value of an output voltage and a reference voltage is amplified, and a detected value of the full-wave rectified alternating current input voltage, a control circuit that on-off controls the switching element based on an output of the multiplier and an inductor current signal detecting an inductor current flowing through the inductor, and at least one circuit of a current peak waveform generator circuit that generates a current peak waveform signal of a waveform tracking a peak value of the inductor current signal, or a waveform similar to the tracking waveform, and a soft-stop overvoltage detection voltage generator circuit that generates a soft-stop overvoltage detection voltage proportional to the output voltage, wherein the output of the multiplier is reduced in accordance with the current peak waveform signal when the current peak waveform signal exceeds a first threshold value, or the output of the multiplier is reduced in accordance with the soft-stop overvoltage detection voltage when the soft-stop overvoltage detection voltage exceeds a second threshold value.

According to the power factor correction type switching power supply unit of this aspect of the invention, as the threshold value (the first threshold value) of the inductor current at which the operation of the soft-stop overcurrent protection circuit starts is made lower than the threshold value (the third threshold value) of the inductor current at which the overcurrent protection circuit starts to operate, the soft-stop overcurrent protection operation using the current peak waveform generator circuit and multiplier is carried out before the overcurrent protection operation starts. As the inductor current is curbed because of this, it is possible to shorten the overcurrent protection operating time, or the overcurrent protection operation becomes unnecessary, and it is possible to eliminate the squeaking.

Along with this, or separately from this, before the on-off operation of the switching element using the overvoltage protection circuit is stopped, the rise of the output voltage is curbed by curbing the inductor current using the soft-stop overvoltage protection circuit, and it is possible to eliminate the squeaking. As the threshold value (the second threshold value) of the output voltage at which the operation of the soft-stop overvoltage protection circuit starts is made lower than the threshold value (the fourth threshold value) of the output voltage at which the overvoltage protection circuit starts to operate, the output of the multiplier is reduced by the soft-stop overvoltage detection voltage before the overvoltage protection operation starts. Because of this, the soft-stop OVP function operates in such a way as to curb the rise of the output voltage, and it is possible to shorten the time for the overvoltage protection, or the overvoltage protection operation becomes unnecessary.

Furthermore, even in the event that the overvoltage protection operation is necessary, as the value of the command to the inductor current at the time of a cancellation of the overvoltage protection is reduced by the soft-stop OVP function, it is possible to curb the squeaking at the time of restarting after stopping the switching operation.

DETAILED DESCRIPTION OF THE EMBODIMENTS

Hereafter, a description will be given of embodiments of the invention, with reference to the drawings.

First Embodiment

Figure 14:
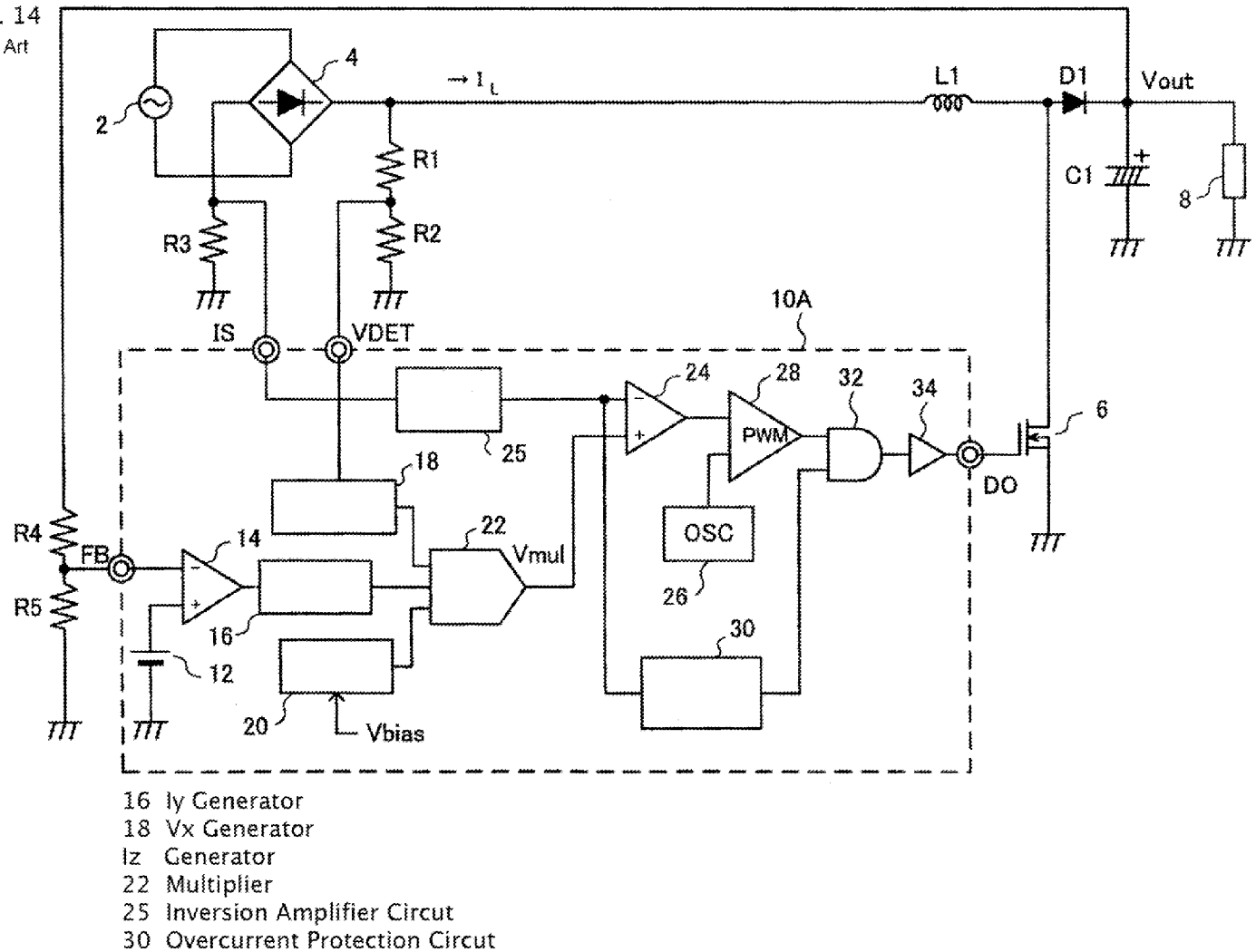
FIG. 14 Prior Art
FIG. 14 is a circuit diagram showing one example of a heretofore known power factor correction type switching power supply unit.
Figure 15:
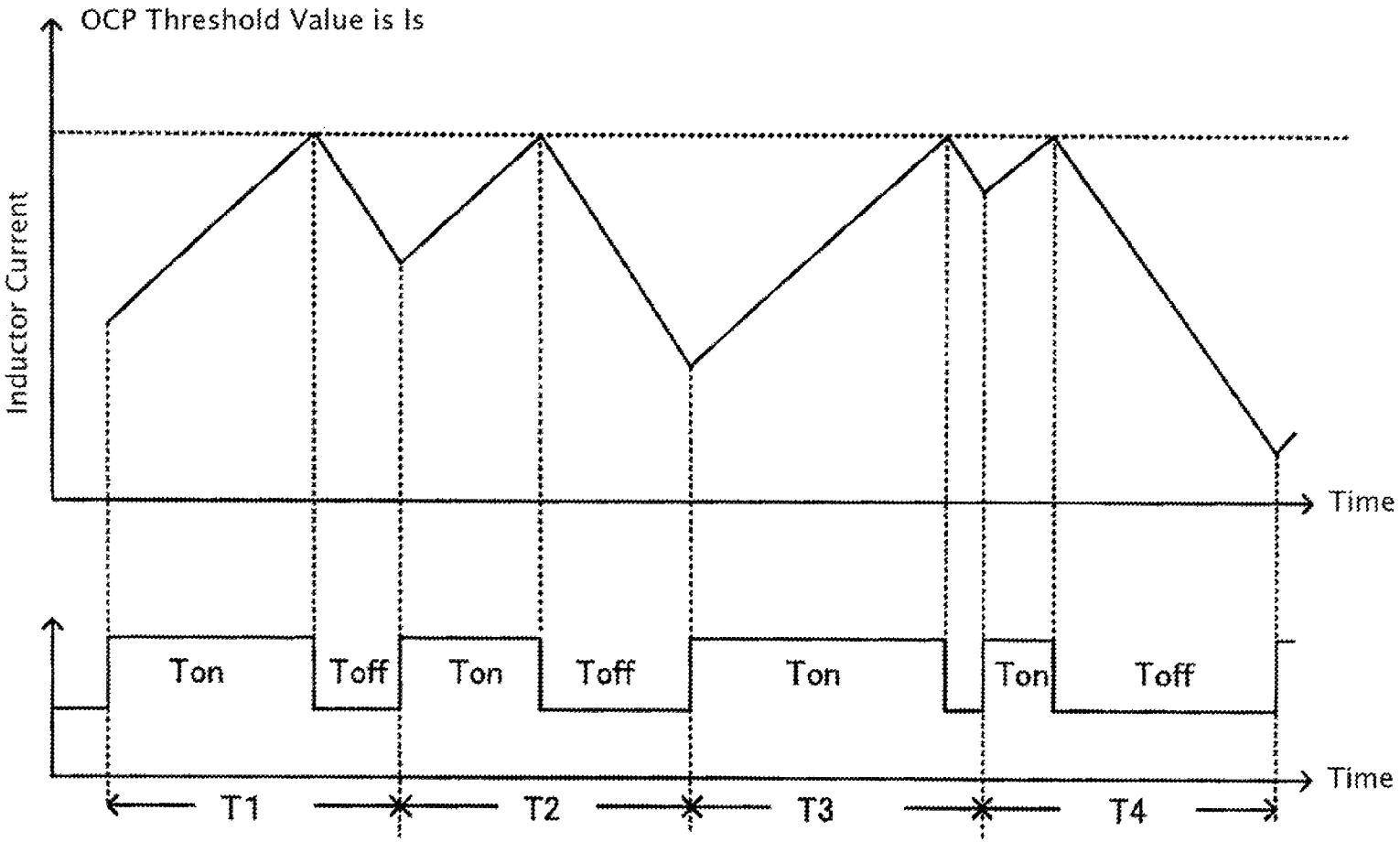
FIG. 15 Prior Art
FIG. 15 is a timing diagram showing a signal waveform illustrating a sub-harmonic oscillation occurring when an OCP function operates at a switching element on duty of 50% or higher.

A power factor correction type switching power supply unit that operates in continuous mode, which is a first embodiment of the invention, has the same configuration as that of the power factor correction type switching power supply unit shown in FIG. 14, which employs a control method called an average current control method, average current mode control, or the like, except that the power factor correction control circuit 10A is replaced with a power factor correction control circuit 10As.

Figure 1:
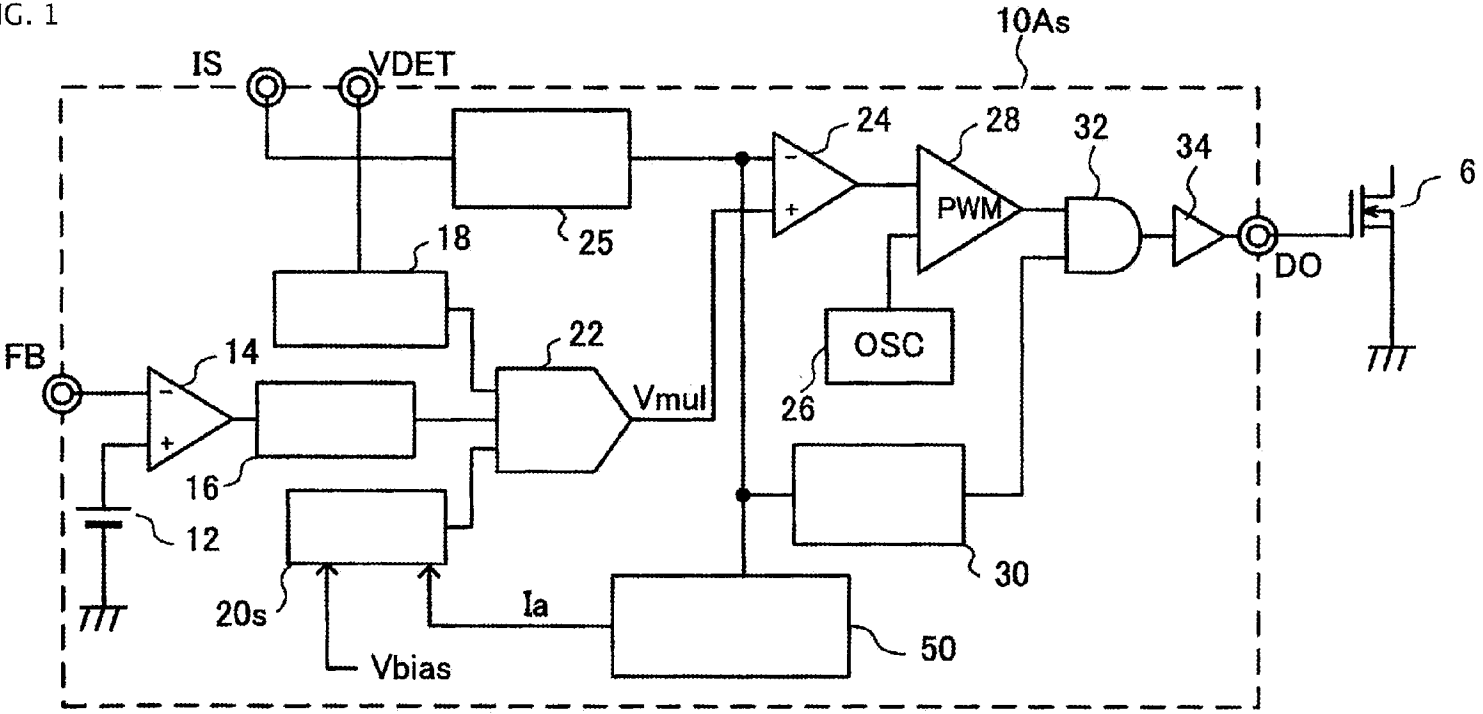
FIG. 1 is a circuit diagram showing a power factor correction control circuit according to a first embodiment of the invention.

FIG. 1 is a circuit diagram showing the power factor correction control circuit according to the first embodiment of the invention. The power factor correction control circuit 10As being one that sinusoidally controls a current flowing to the alternating current commercial power supply 2 side while stabilizing the direct current output voltage Vout, in the same way as the power factor correction control circuit 10A, its feedback voltage input terminal FB is connected to an input terminal of a voltage error amplifier 14 together with a reference voltage source 12, which sets a voltage command value for the direct current output voltage Vout. The voltage error amplifier 14 generates a voltage error signal (Ver) wherein the difference between the detected value of the direct current output voltage Vout, which is a return signal proportional to the direct current output voltage Vout, and the voltage command value of the reference voltage source 12 is amplified. Then, the voltage error signal of the voltage error amplifier 14 is input into an Iy generator 16 (a first input signal generator circuit), and converted into a current signal Iy (a first input signal) indicating a voltage error.

Figure 16:
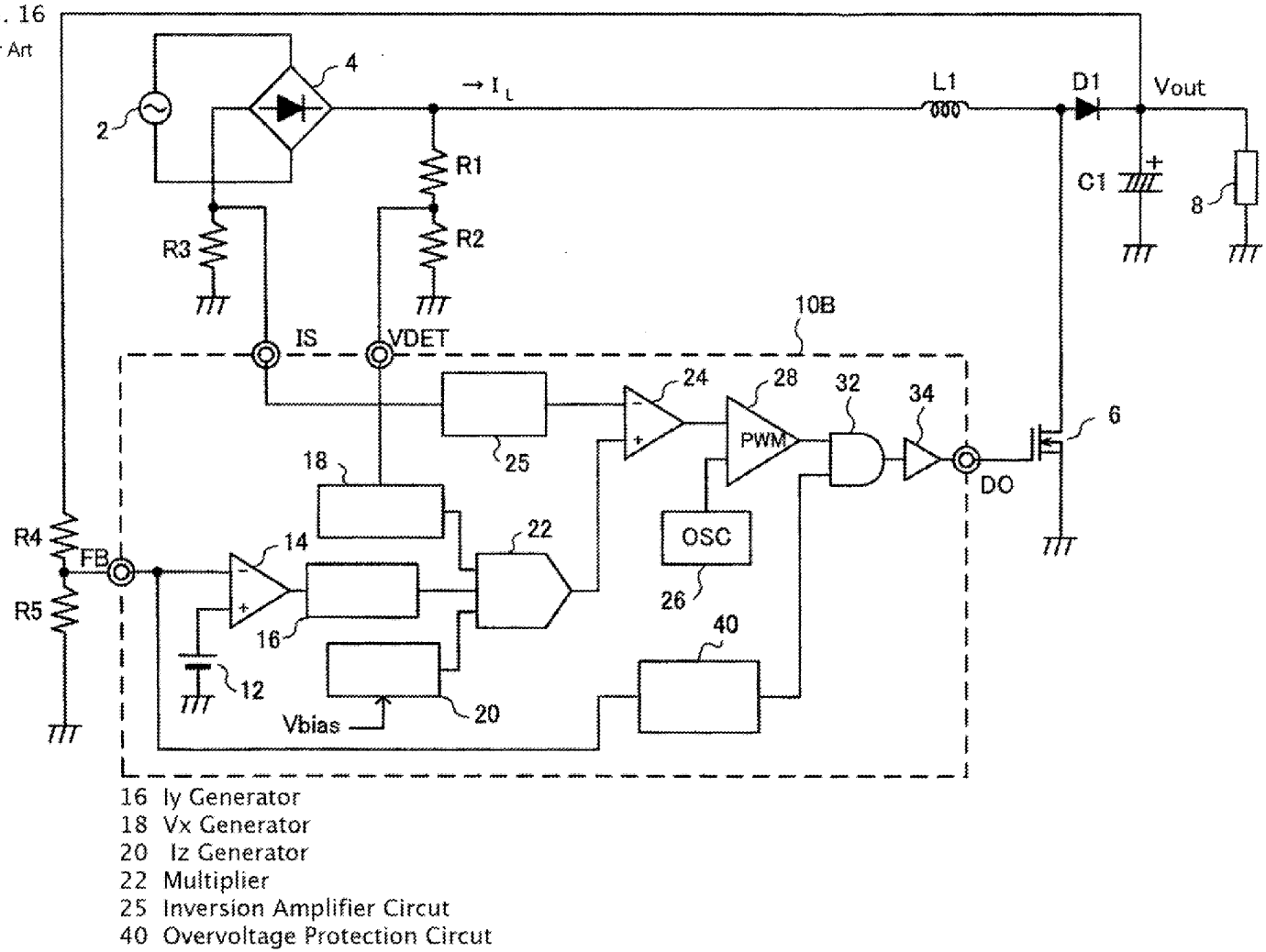
FIG. 16 Prior Art
FIG. 16 is a circuit diagram showing another example of the heretofore known power factor correction type switching power supply unit, this one including an overvoltage protection circuit.
Figures 17A, 17B:
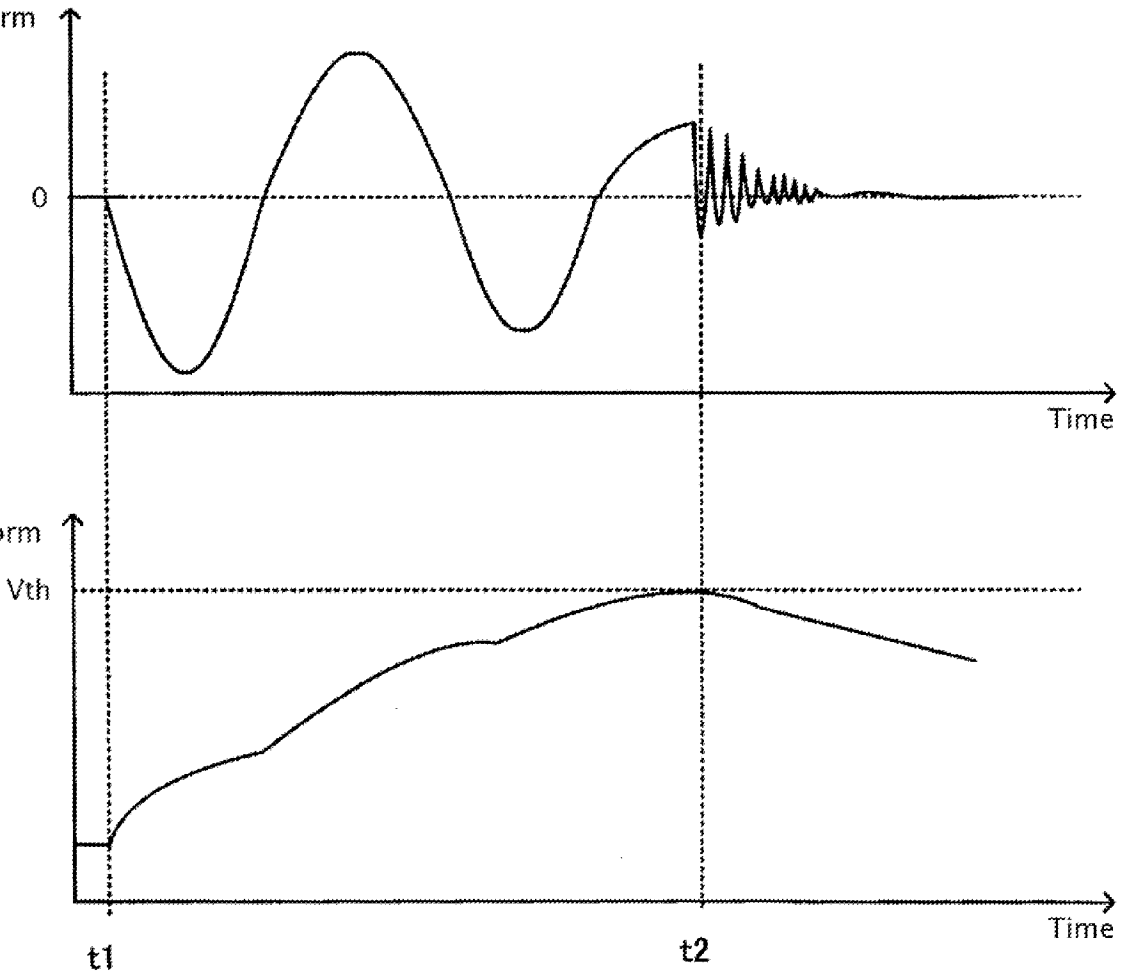
FIG. 17a Prior Art
FIG. 17b Prior Art
FIGS. 17A and 17B are timing diagrams showing a signal waveform for overvoltage protection at a start-up time.
Figures 18A, 18B:
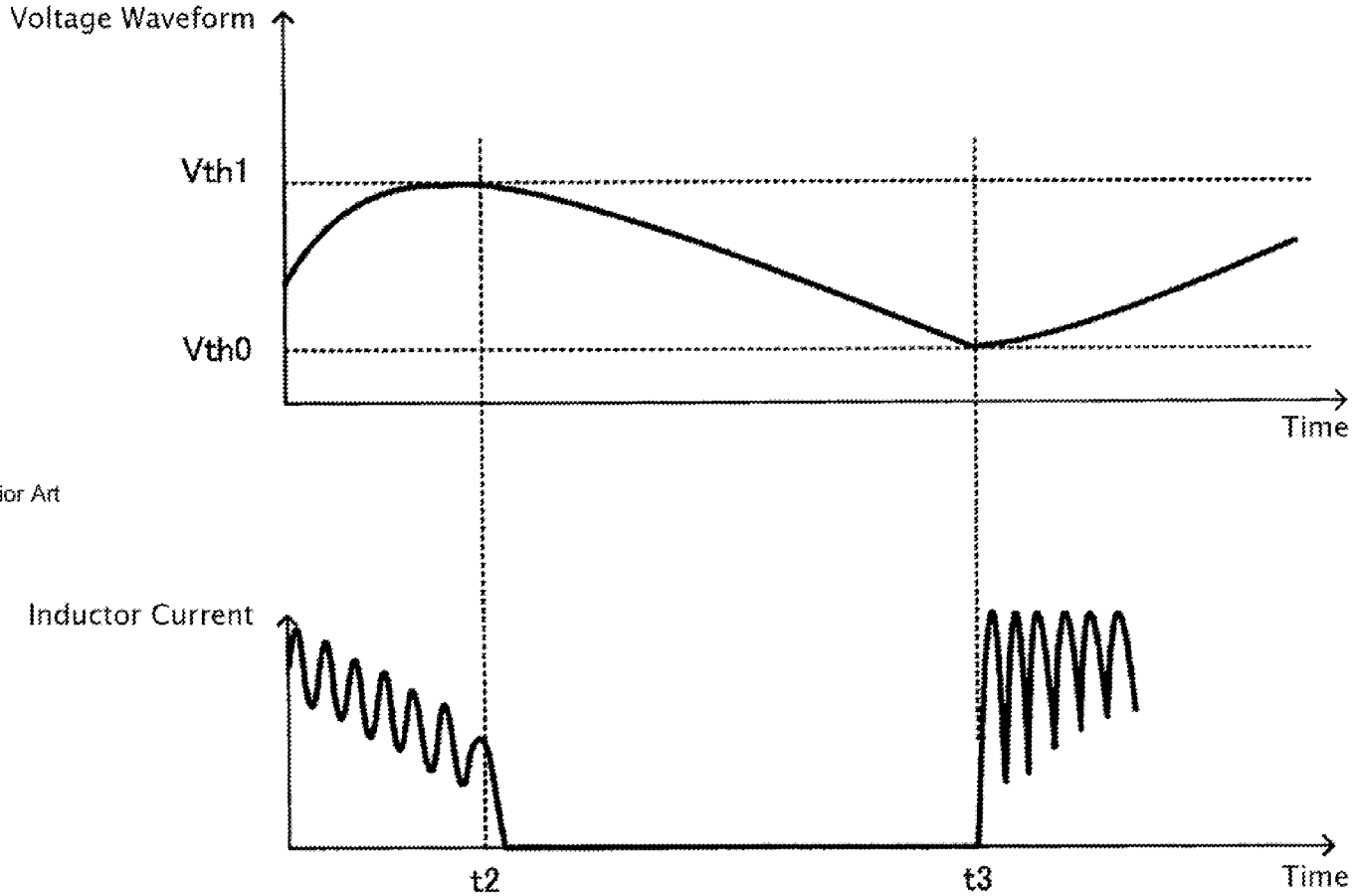
FIG. 18a Prior Art
FIG. 18b Prior Art
FIGS. 18A and 18B are timing diagrams showing a signal waveform at a time of a cancellation of the overvoltage protection.

In the power factor correction control circuit 10As, its multiplier input terminal VDET and a Vx generator 18 (a second input signal generator circuit) being connected, the detected value (a divided voltage value in this case) of the output voltage of a full-wave rectifier 4 is input into the Vx generator 18, and converted into a voltage signal Vx (a second input signal). The Vx generator 18 in the first embodiment is simply a wiring, in the same way as the Vx generator 18 of the heretofore known power factor correction type switching power supply unit shown in FIG. 14 or FIG. 16. Also, a constant voltage signal Vbias generated by an unshown circuit is input into an Iz generator 20*s*, and the constant voltage signal Vbias is converted into a current signal Iz (a gain adjustment signal) by the Iz generator 20*s*.

A multiplier 22 multiplies the current signal Iy of the Iy generator 16 and the voltage signal Vx from the Vx generator 18 corresponding to the divided voltage value of the output voltage of the full-wave rectifier 4 (the detected value of a full-wave rectified alternate current input voltage). The result of the multiplication is output as a current reference signal Vmul to the non-inversion input terminal of a current error amplifier 24. The current error amplifier 24, with an inductor current signal, which is a voltage signal wherein an inductor current $I_L$ is detected by the current detecting resistor R3 as an input into an inversion input terminal of the current error amplifier 24 from an inductor current signal generating input terminal IS, outputs a current error signal wherein the difference between the current reference signal Vmul and an inductor current signal is amplified. In the oscillator circuit (OSC) 26, a sawtooth wave or triangular wave of a constant frequency is generated as a carrier signal that determines a switching cycle, which is a cycle of an on-off operation of the switching element 6, and input into a PWM comparator 28. The PWM comparator 28, with the carrier signal and the current error signal from the current error amplifier 24 as inputs, generates a PWM control signal to be applied to the gate terminal of the switching element 6 via an AND circuit 32 and a driver circuit 34 by comparing the magnitudes of the signals.

An overcurrent protection circuit 30 is connected to an inversion amplifier circuit 25, and an inductor current signal is input. A third threshold value of a predetermined size is set in the overcurrent protection circuit 30 in order to limit the maximum value of the inductor current $I_L$. Because of this, on it being detected that the inductor current signal has exceeded the third threshold value, an overcurrent detection signal L (Low) is input into the AND circuit 32, and the output of the AND circuit 32 compulsorily becomes L. A switching signal for turning the switching element 6 on and off is output to an output terminal DO of the power factor correction control circuit 10As from the AND circuit 32 via the driver circuit 34.

In the same way, a current peak waveform generator circuit 50 and the Iz generator 20*s* limiting the peak value of the inductor current $I_L$, the current peak waveform generator circuit 50 is connected to the inversion amplifier circuit 25. However, a first threshold value smaller than the third threshold value set in the overcurrent protection circuit 30 is set in the Iz generator 20*s*. Then, a configuration is such that when a current peak waveform signal corresponding to an envelope of the peak value of the inductor current signal of each switching cycle has exceeded the first threshold value, the size of the current signal Iz output to the multiplier 22 is adjusted.

Next, a description will be given of the inversion amplifier circuit 25 and current peak waveform generator circuit 50, and of the Iz generator 20*s*, using FIGS. 2 and 3 respectively.

Figure 2:
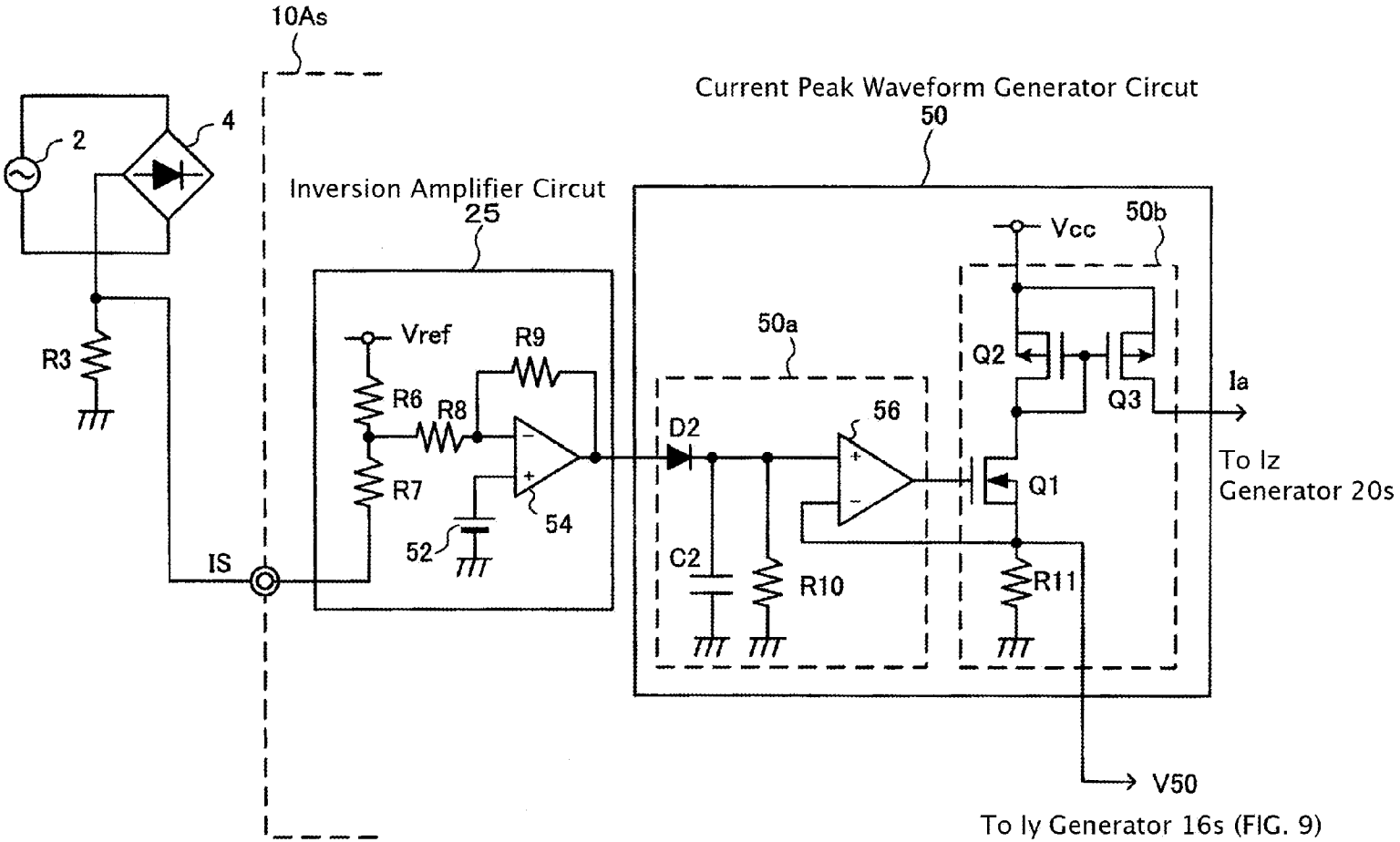
FIG. 2 is a circuit diagram showing a specific configuration of an inversion amplifier circuit and of a current peak waveform generator circuit used in the realization of a soft-stop OCP function.

FIG. 2 is a circuit diagram showing a specific configuration of the inversion amplifier circuit 25 and of the current peak waveform generator circuit 50 used in the realization of a soft-stop OCP function. Herein, as the voltage signal from the inductor current signal generating input terminal IS is of a negative potential, it is converted into an inductor current signal with a positive potential in the inversion amplifier circuit 25. Also, the soft-stop OCP function refers to a kind of function to be described in detail hereafter whereby, rather than the inductor current $I_L$ being suddenly turned off on the inductor current $I_L$ exceeding a certain threshold value, the inductor current $I_L$ is gradually curbed.

The inversion amplifier circuit 25 has a series circuit of resistors R6 and R7, one end of which is connected to a reference voltage Vref generated by an unshown circuit, resistors R8 and R9, a reference voltage power supply 52, and an operational amplifier 54. The resistor R6, one of the series circuit of resistors R6 and R7, is such that one end is connected to the reference voltage Vref, and the other end is connected to the inversion input terminal of the operational amplifier 54 via the resistor R8. The resistor R7, the other of the series circuit of resistors R6 and R7, is connected to the inductor current signal generating input terminal IS. The operational amplifier 54 is such that its non-inversion input terminal is connected to the reference voltage power supply 52, and the output terminal is connected to the inversion input terminal via the resistor R9. As this kind of inversion amplifier circuit 25 itself is commonly known, a description of its operation will be omitted, but by means of the heretofore described configuration, a signal similar to the voltage signal from the inductor current signal generating input terminal IS, but with positive and negative inverted, is output by the inversion amplifier circuit 25.

The current peak waveform generator circuit 50 is configured of a peak current holding portion 50*a*, and a signal output portion 50*b* that generates and outputs a current peak waveform signal for inputting into the Iz generator 20*s*. The peak current holding portion 50*a* of the current peak waveform generator circuit 50 is configured of a diode D2, a capacitor C2, a resistor R10, and an operational amplifier 56. The output signal of the inversion amplifier circuit 25 is supplied to the anode side of the diode D2, and the parallel circuit of the capacitor C2 and resistor R10, one end of each of which is grounded, is connected to the cathode side. Furthermore, the operational amplifier 56 is such that its non-inversion input terminal is connected to the other end of each of the capacitor C2 and resistor R10, and its output signal is supplied to the signal output portion 50*b* at the latter stage. Herein, when the output voltage of the inversion amplifier circuit 25 is larger than the charging voltage of the capacitor C2, a current flowing via the diode D2 charges the capacitor C2. Also, the configuration is such that on the output voltage of the inversion amplifier circuit 25 becoming smaller than the charging voltage of the capacitor C2, the resistor R10 becomes a discharge circuit, and discharges the capacitor C2.

That is, on a voltage signal corresponding to the inductor current $I_L$ being applied to the inductor current signal generating input terminal IS, an inductor current signal, wherein the voltage signal is inverted and amplified by the inversion amplifier circuit 25, is input into the peak current holding portion 50*a* of the current peak waveform generator circuit 50. Then, the peak current holding portion 50*a* stores the peak value of the inductor current signal in each switching cycle in the capacitor C2 and, on the peak value passing, gradually discharges the capacitor C2 with the resistor R10 discharge circuit until the peak value of the inductor current signal of the next switching cycle arrives. At this time, in the event that the peak value of the inductor current signal in the next switching cycle is higher than the value stored in the capacitor C2, the peak value is stored in the capacitor C2, while in the event that it is lower, the discharging of the capacitor C2 with the discharge circuit is continued. By this means, a signal (hereafter referred to as an envelope signal) corresponding to an envelope voltage signal connecting the peak values of the inductor current signals is generated at either end of the capacitor C2, and the envelope signal is input into the signal output portion 50*b* via the operational amplifier 56.

The signal output portion 50*b* is a voltage-to-current converter circuit configured of MOS transistors Q1 to Q3, and a resistor R11. The gate terminal of the MOS transistor Q1 is connected to the output terminal of the operational amplifier 56 of the peak current holding portion 50*a*, and its drain terminal is connected to a power supply terminal Vcc via the separate MOS transistor Q2. The source terminal of the MOS transistor Q1 is grounded via the resistor R11. Then, as well as the connection point of the source terminal and resistor R11 being connected to the inversion input terminal of the operational amplifier 56 of the former stage, a soft-stop OCP voltage signal V50 is output from the connection point to an Iy generator of FIG. 9, to be described hereafter. As the two input terminals of the operational amplifier 56 are hypothetically short-circuited (an imaginary short), the soft-stop OCP voltage signal V50 is equivalent to the voltages at either end of the capacitor C2, that is, to the envelope signal. Then, the soft-stop OCP voltage signal V50, that is, a current proportional to the envelope signal, flows through the resistor R11. Also, the MOS transistors Q2 and Q3 configure a current mirror circuit. Consequently, a current of a size equivalent to the value of the current flowing through the resistor R11 via the MOS transistor Q1, that is, a current signal having a current value proportional to the envelope signal, is output from the source terminal of the MOS transistor Q3 to the Iz generator 20*s* as a current peak waveform signal Ia.

Figure 3:
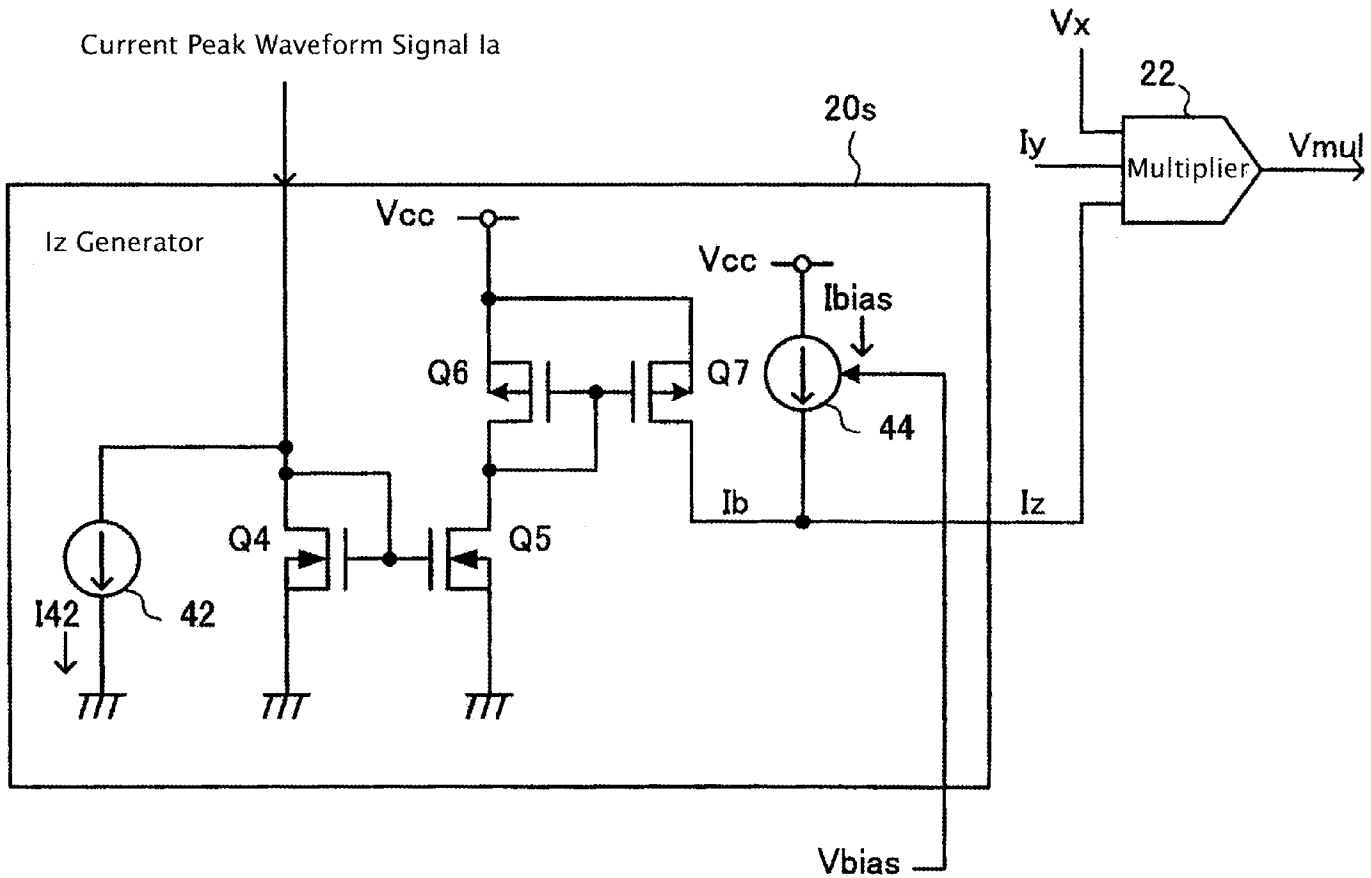
FIG. 3 is a circuit diagram showing a specific configuration of an Iz generator for generating a current signal Iz.

FIG. 3 is a circuit diagram showing a specific configuration of the Iz generator for generating the current signal Iz.

The Iz generator 20*s* is configured of constant current sources 42 and 44, and four MOS transistors Q4 to Q7. Herein, a former stage current mirror circuit is configured by the MOS transistors Q4 and Q5, and a latter stage current mirror circuit is configured by the MOS transistors Q6 and Q7.

In the former stage current mirror circuit, the constant current source 42 is provided in parallel with the input side MOS transistor Q4, and the current peak waveform signal Ia supplied from the current peak waveform generator circuit 50 flows in such a way that the current is divided between the constant current source 42 and the drain terminal of the MOS transistor Q4. Also, in the latter stage current mirror circuit, the constant current source 44 is provided in parallel with the output side MOS transistor Q7. The constant voltage signal Vbias generated by an unshown circuit is input into the constant current source 44 as a control signal, and the size of a bias current value (constant current) Ibias is determined by the constant voltage signal Vbias. Consequently, a soft-stop OCP threshold value current is determined by a current value I42 of the constant current source 42, and when the current peak waveform signal Ia flows in excess of the I42, a current signal Ib that fluctuates by a size proportional to the difference between the Ia and I42 is output from the latter stage current mirror circuit. Then, the current signal Iz, wherein the current signal Ib is added to the constant current Ibias, is output from the constant current source 44 to the multiplier 22.

The current signal Iz is input into the multiplier 22 as a gain adjustment signal. In the multiplier 22, a multiplication is carried out of the current signal Iy from the Iy generator 16 and the voltage signal Vx from the Vx generator 18 corresponding to the detected value (the divided voltage value) of the output voltage of the full-wave rectifier 4. Then, the current signal Iz becomes a bias current that determines the gain of the multiplier 22 but, as the gain is inversely proportional to the current signal Iz, the current signal Iz acts in such a way as to divide the product of the voltage signal Vx and current signal Iy. Consequently, the gain of the multiplier 22 changes depending on the current peak waveform signal Ia of the current peak waveform generator circuit 50, and it is possible to adjust the current reference signal Vmul to the non-inversion input terminal of the current error amplifier 24. Details of the configuration and operation of the multiplier 22 will be described hereafter.

FIGS. 4A to 4E are signal waveform diagrams illustrating the signal generation procedure of the Iz generator of FIG. 3.

Figure 4A:
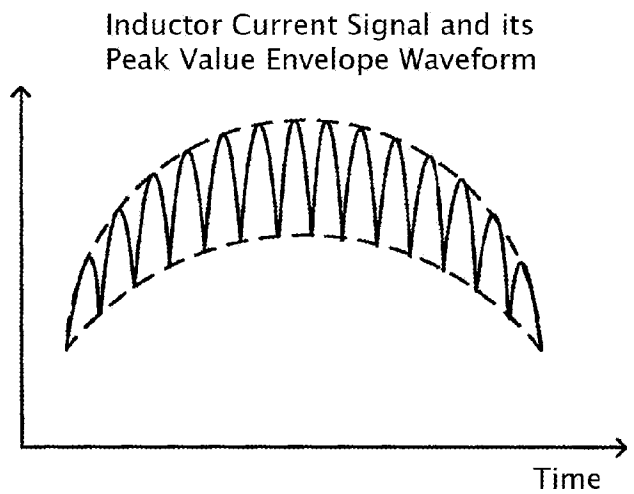
FIGS. 4A to 4E are signal waveform diagrams illustrating a signal generation procedure of the Iz generator of FIG. 3.
Figure 4B:
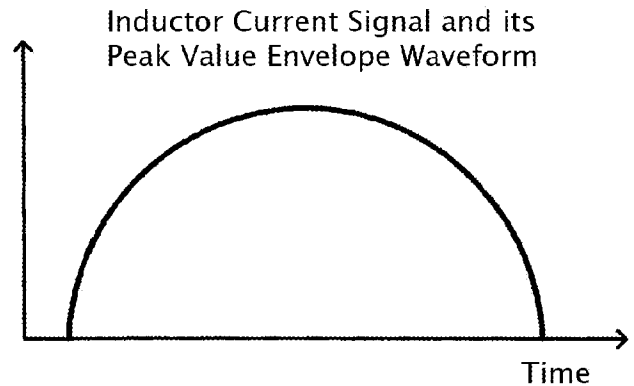
Figure 4C:
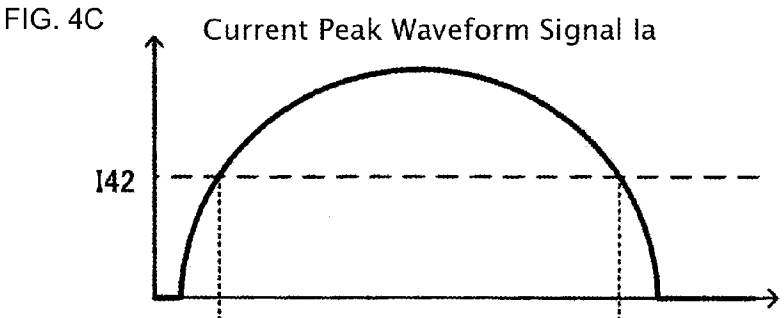
Figure 4D:
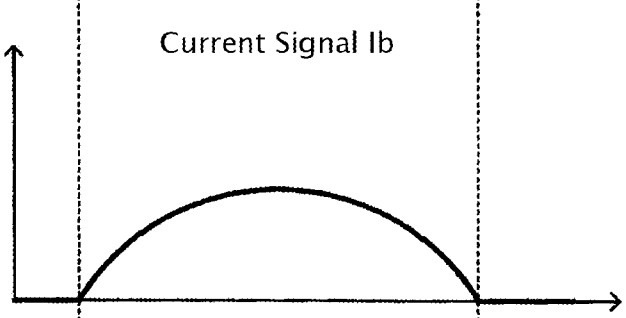
Figure 4E:
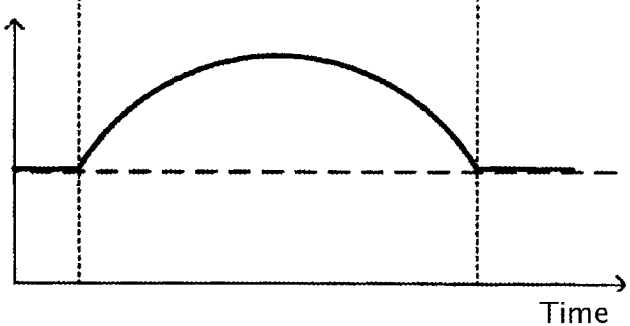

FIG. 4A shows the inductor current signal (solid line) and the envelope waveform (upper portion broken line) of its peak values. FIG. 4B shows only the envelope waveform of the peak values of the inductor current signal. FIG. 4C shows the relationship between the current peak waveform signal Ia, input into the Iz generator 20*s* from the current peak waveform generator circuit 50, and the current threshold value (I42). FIG. 4D shows the current signal Ib output from the latter stage current mirror circuit of the Iz generator 20*s*. Also, FIG. 4E shows the current signal Iz output to the multiplier 22 as the gain adjustment signal.

Figure 5:
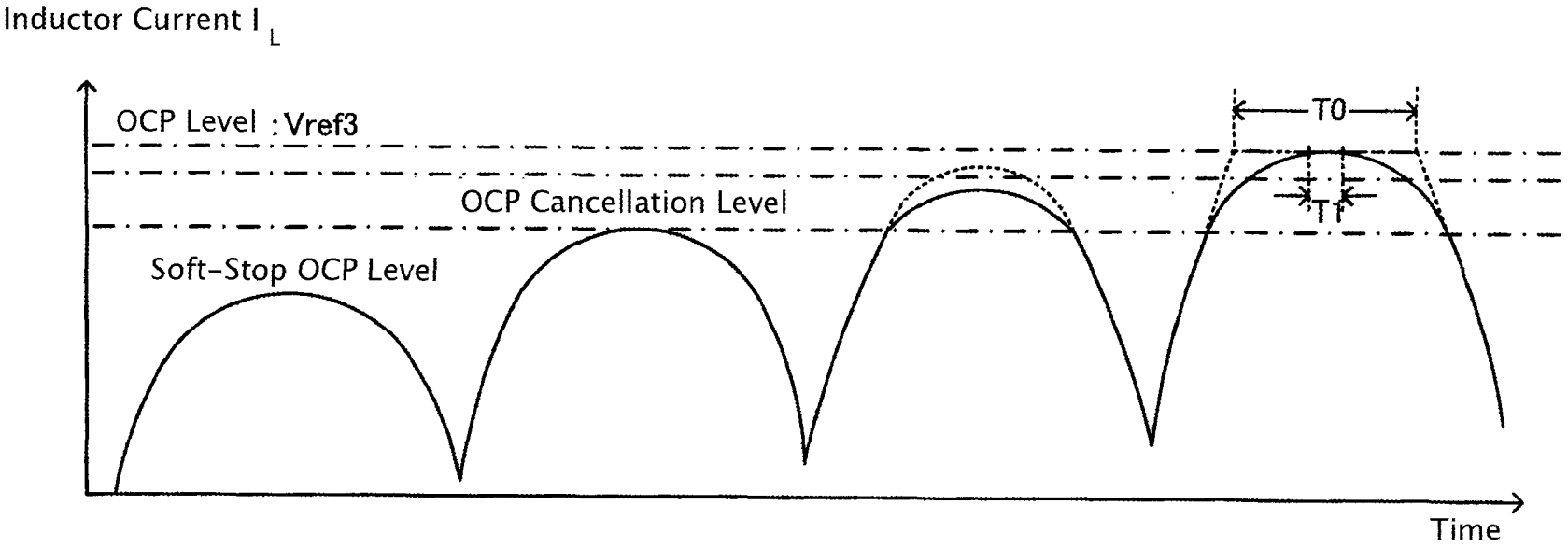
FIG. 5 is a timing diagram showing a signal waveform at a time of a soft-stop overcurrent protection operation.

FIG. 5 is a timing diagram showing a signal waveform at a time of a soft-stop overcurrent protection operation.

Herein, it is shown how the inductor current $I_L$ is adjusted by the current peak waveform generator circuit 50 (FIG. 2) and Iz generator 20*s* (FIG. 3) of the invention with respect to the first threshold value determining the set soft-stop OCP level. Herein, it is the current value I42 of the constant current source 42 shown in FIG. 3 that determines the first threshold value. That is, the timing at which the current peak waveform signal Ia exceeds the current value I42 in FIG. 4C is the timing at which the inductor current exceeds the soft-stop OCP level in FIG. 5. FIG. 5, as well as showing the inductor current $I_L$ in the embodiment with a solid line, shows the heretofore known inductor current $I_L$ with a dotted line in conjunction therewith. In the case of the embodiment, by the gain of the multiplier 22 being lowered (the degree to which it is lowered is a monotonic increase with respect to the difference between the inductor current $I_L$ and the first threshold value) on the first threshold value being exceeded, and the rise of the inductor current $I_L$ being curbed, the voltage waveform is reduced as a whole. For this reason, it is possible to eliminate a squeaking due to a sub-harmonic oscillation of the inductor current $I_L$.

FIG. 5 also shows a current level (OCP level) for preventing an overcurrent set in the overcurrent protection circuit 30.

An unshown reference voltage source that generates the third threshold value (a reference voltage Vref3), and an unshown comparator, are used in the overcurrent protection circuit 30 of FIG. 1. Using the comparator, the output of the inversion amplifier circuit 25 is compared with the third threshold value (the reference voltage Vref3) and, on the output of the inversion amplifier circuit 25 becoming equal to or greater than the third threshold value (the reference voltage Vref3), it is determined that the inductor current $I_L$ has reached the OCP level, and the overcurrent detection signal is output.

It is preferable that the comparator provided in the overcurrent protection circuit 30, into which the third threshold value is input as the determination reference, is a hysteresis comparator. In this case, the hysteresis comparator has a fifth threshold value (this is a threshold value for stopping the output of the overcurrent detection signal) of a value lower than the third threshold value, and is equipped with a function whereby the determination reference is switched between the third threshold value and fifth threshold value by the overcurrent detection signal itself. Furthermore, the third and fifth threshold values determining the OCP level are both set at high values compared with the first threshold value determining the soft-stop OCP level.

In the case of the embodiment, heretofore, even when the inductor current $I_L$ exceeds the OCP level, as the rise of the inductor current $I_L$ is curbed on the inductor current signal exceeding the first threshold value determining the soft-stop OCP level, it is possible to arrange in such a way that it does not happen that the inductor current $I_L$ stops the switching element 6 by exceeding the OCP level. Then, furthermore, on the inductor current $I_L$ continuing to increase and exceeding the OCP level, the switching element is stopped but, even in this kind of case, as is shown by comparing with the protection operation with the heretofore known power factor correction control circuit 10A using only the overcurrent protection circuit 30 in FIG. 5, it is possible to shorten a period T1, for which the OCP level is reached and the switching element 6 stopped, in comparison with a period T0 in the heretofore known case (T1<T0). Even when making the comparator for generating the overcurrent detection signal a hysteresis comparator, it is possible to increase the advantage of shortening the period for which the switching element 6 is stopped by making the fifth threshold level higher than the first threshold value determining the soft-stop OCP level. This is because the timing of finishing the period for which the switching element 6 is stopped is earlier than that heretofore known, and consequently, it is possible to shorten the overcurrent protection operation time, and suppress the squeaking.

Second Embodiment

Figure 6:
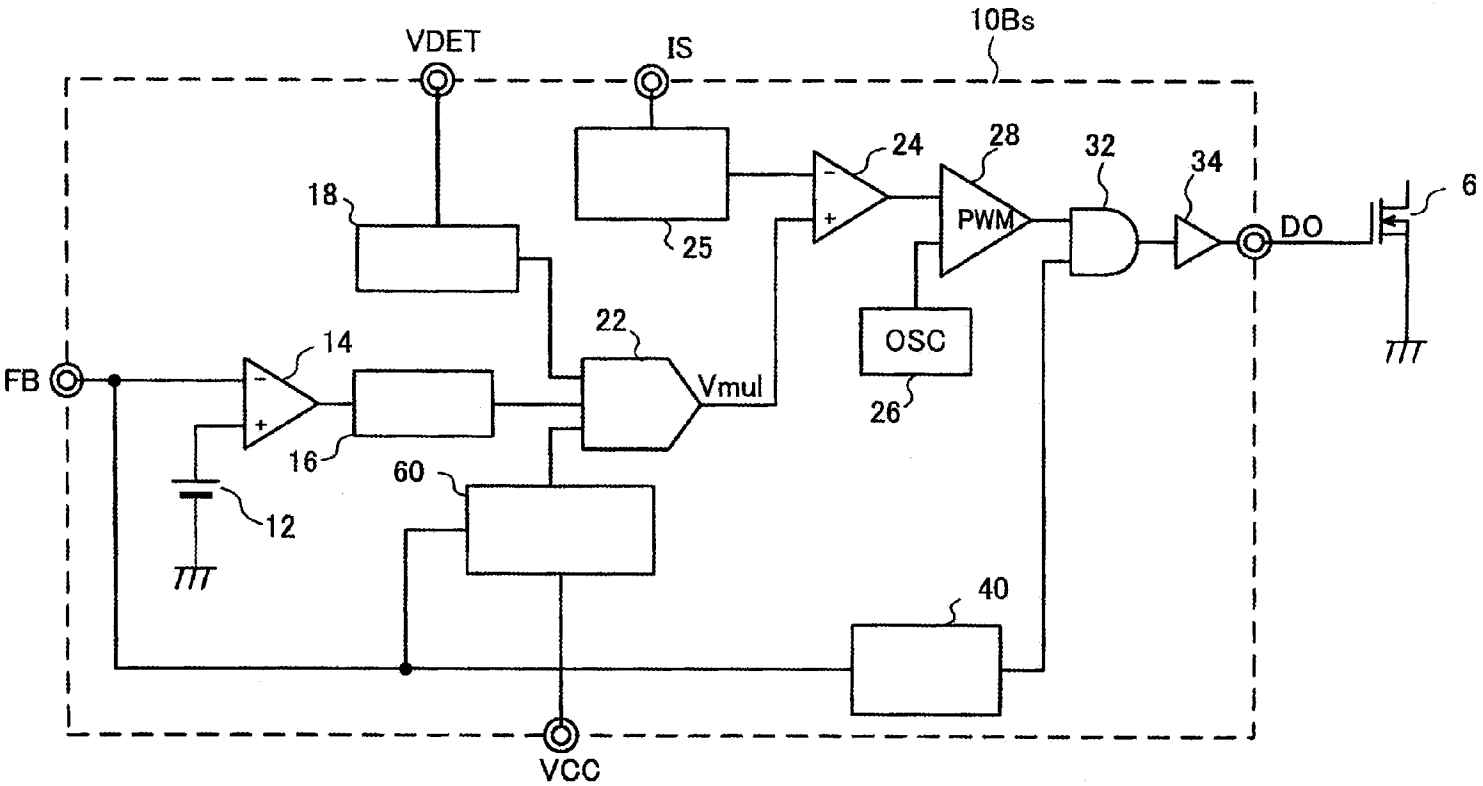
FIG. 6 is a circuit diagram showing a power factor correction control circuit that operates in continuous mode, which is a second embodiment of the invention.

FIG. 6 is a circuit diagram showing a power factor correction control circuit 10Bs of a power factor correction type switching power supply unit that operates in continuous mode, which is a second embodiment of the invention. A point in which the power factor correction control circuit 10Bs differs from that of the first embodiment is that an overvoltage protection circuit 40 is provided in place of the overcurrent protection circuit 30, and the on-off operation of the switching element 6 is stopped when an output direct current voltage rises to a setting value or above. Also, the inductor current $I_L$ is curbed, and the squeaking prevented, by reducing the output of the multiplier 22 using a soft-stop overvoltage protection circuit 60 in place of the Iz generator 20*s*.

In the power factor correction control circuit 10Bs, the overvoltage protection circuit 40 is connected to the feedback voltage input terminal FB, and a return signal proportional to the direct current output voltage Vout is input. In the overvoltage protection circuit 40, a fourth threshold value of a predetermined size is set, it is detected that the return signal has exceeded the fourth threshold value, and an L (Low) overvoltage detection signal is input into the AND circuit 32, compulsorily making the output of the AND circuit 32 L. A switching signal for turning the switching element 6 on and off is output to the output terminal DO of the power factor correction control circuit 10Bs from the AND circuit 32 via the driver circuit 34.

Also, the soft-stop overvoltage protection circuit 60 of the power factor correction control circuit 10Bs is connected to the feedback voltage input terminal FB in the same way as the overvoltage protection circuit 40. The soft-stop overvoltage protection circuit 60 supplies the current signal Iz to the multiplier 22 in place of the Iz generator 20*s* of FIG. 3. A second threshold value lower than the fourth threshold value set in the overvoltage protection circuit 40 is set in the soft-stop overvoltage protection circuit 60, and when the voltage value of the return signal from the feedback voltage input terminal FB exceeds the second threshold value, the current signal Iz functions as an overvoltage prevention signal.

Next, a description will be given of the soft-stop overvoltage protection circuit 60 and its soft-stop OVP function.

Figure 7:
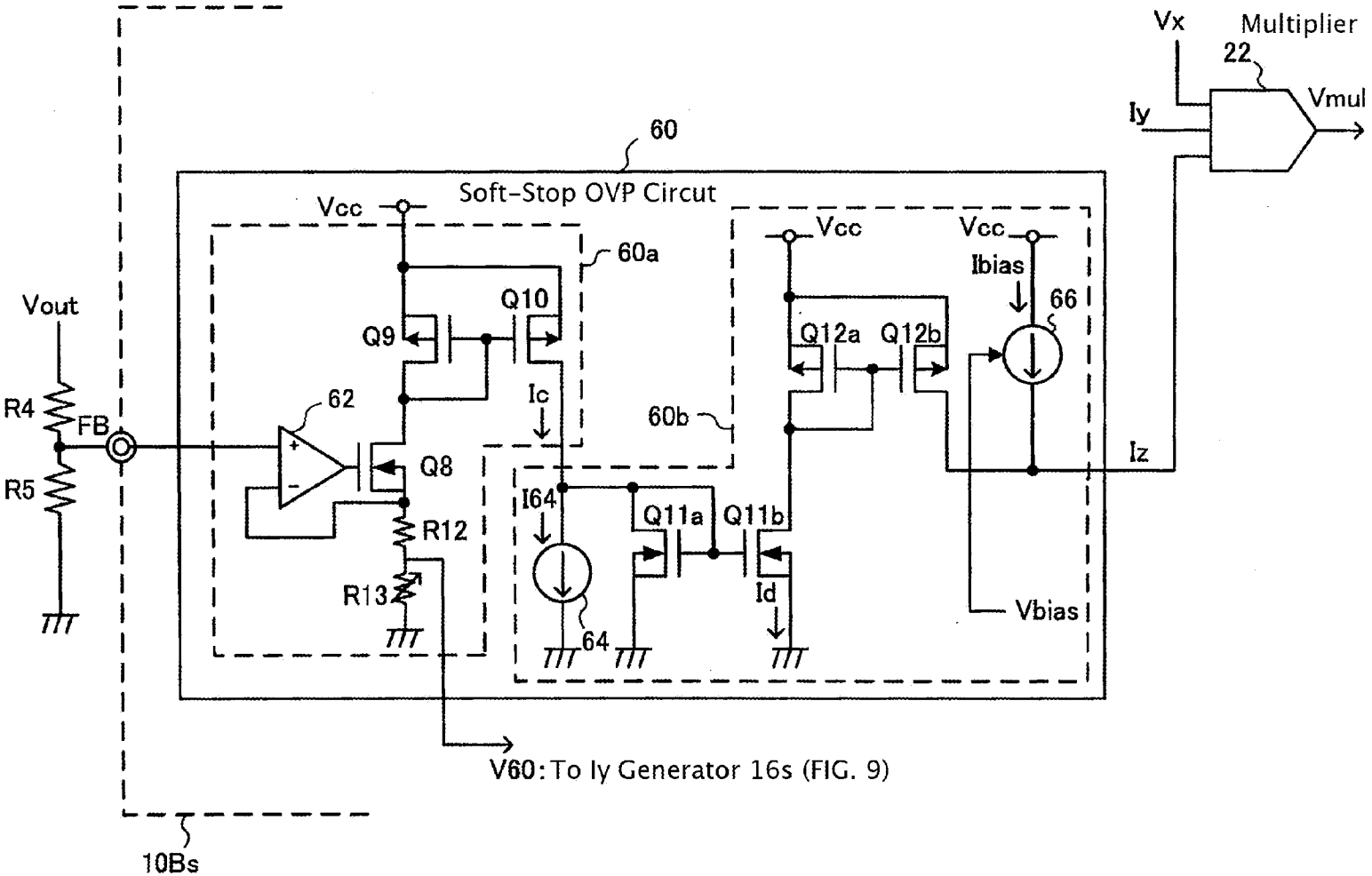
FIG. 7 is a circuit diagram showing a specific configuration of a soft-stop overvoltage protection circuit with a soft-stop OVP function.

FIG. 7 is a circuit diagram showing a specific configuration of a soft-stop overvoltage protection circuit with a soft-stop OVP function.

The soft-stop overvoltage protection circuit (hereafter called the soft-stop OVP circuit) 60 is configured of a voltage detecting portion 60*a* that detects a soft-stop overvoltage detection voltage (hereafter called the soft-stop OVP voltage signal), and converts it into a current signal, and a signal output portion 60*b* that inputs the current signal Iz into the multiplier 22 as a gain adjustment signal. The voltage detecting portion 60*a* is configured of an operational amplifier 62 whose non-inversion input terminal is connected to the feedback voltage input terminal FB, a series circuit of resistors R12 and R13, one end of which is grounded, and MOS transistors Q8 to Q10. The operational amplifier 62 is such that its inversion input terminal is connected to the connection point of the resistor R12 and MOS transistor Q8, and its output terminal is connected to the gate terminal of the MOS transistor Q8. The drain terminal of the MOS transistor Q8 is connected to the power supply terminal Vcc via the separate MOS transistor Q9. The source terminal of the MOS transistor Q8 is grounded via the series circuit of resistors R12 and R13. Then, a soft-stop OVP voltage signal (a soft-stop overvoltage detection voltage) V60 is output from the connection point of the resistors R12 and R13 to an Iy generator 16*s* of FIG. 9, to be described hereafter. As the two input terminals of the operational amplifier 62 are in an imaginary short state (hypothetically short-circuited), the soft-stop OVP voltage signal V60 is equivalent to the divided voltage value of the direct current output voltage Vout input into the feedback voltage input terminal FB. For this reason, as a current proportional to the divided voltage value of the direct current output voltage Vout flows through the resistor R13, the soft-stop OVP voltage signal V60 has a value proportional to the direct current output voltage Vout.

Also, the MOS transistors Q9 and Q10 configure a current mirror circuit. Consequently, an overvoltage prevention current Ic proportional to the soft-stop OVP voltage signal V60 is output from the source terminal of the MOS transistor Q10 to the signal output portion 60*b*.

The signal output portion 60*b* is configured of a constant current source 64, and four MOS transistors Q11*a*, Q11*b*, Q12*a*, and Q12*b*. Herein, a former stage current mirror circuit is configured by the MOS transistors Q11*a* and Q11*b*, and a latter stage current mirror circuit is configured by the MOS transistors Q12*a* and Q12*b*.

In the former stage current mirror circuit, the constant current source 64 is provided in parallel with the input side MOS transistor Q11*a*, and the overvoltage prevention current Ic supplied from the voltage detection portion 60*a* flows in such a way that the current is divided between the constant current source 64 and the drain terminal of the MOS transistor Q11*a*. Also, in the latter stage current mirror circuit, a constant current source 66 is provided in parallel with the output side MOS transistor Q12*b*. The constant voltage signal Vbias generated by an unshown circuit is input into the constant current source 66 as a control signal, and the size of the bias current value (constant current) Ibias is determined by the constant voltage signal Vbias. Consequently, a soft-stop OVP threshold value current is determined by a current value I64 of the constant current source 64, and when the overvoltage prevention current Ic flows in excess of the I64, an overvoltage prevention signal Id, which is a current signal fluctuating by a size proportional to the difference between the Ic and I64, is output from the latter stage current mirror circuit. Then, the current signal Iz, wherein the overvoltage prevention signal Id is added to the constant current Ibias, is output from the constant current source 66 to the multiplier 22.

In this way, the current signal Iz is input into the multiplier 22 as a gain adjustment signal, as well as into which the current signal Iy from the Iy generator 16 and the voltage signal Vx from the Vx generator 18 (this is also a simple wiring) corresponding to the detected value (the divided voltage value) of the output voltage of the full-wave rectifier 4 are input and, as well as those being multiplied, the current signal Iz acts in such a way as to divide the product of the Vx and Iy, as heretofore described. Then, as the gain of the multiplier 22 is inversely proportional to the current signal Iz, wherein the overvoltage prevention signal Id of the soft-stop OVP circuit 60 is added to the bias current value Ibias as heretofore described, on the soft-stop OVP voltage signal increasing and the soft-stop OVP function operating, it is possible to reduce the current reference signal Vmul input into the non-inversion input terminal of the current error amplifier 24. Because of this, it is possible to reduce the inductor current $I_L$, and curb the rise of the current output voltage Vout.

Figures 8A, 8B, 8C:
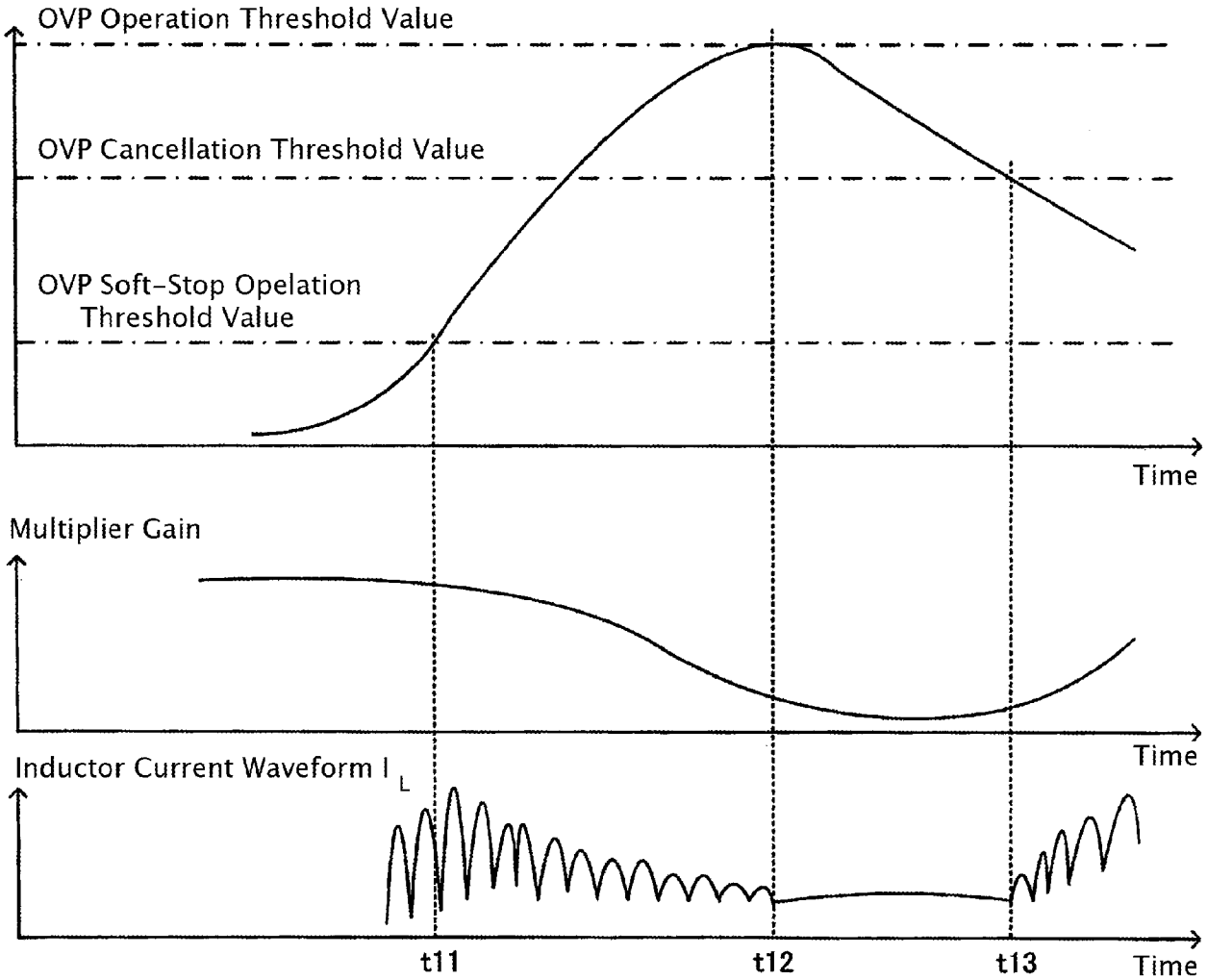
FIGS. 8A to 8C are timing diagrams showing a signal waveform illustrating a soft-stop overvoltage protection operation.

FIGS. 8A to 8C are timing diagrams showing a signal waveform illustrating a soft-stop overvoltage protection operation.

FIG. 8A shows how the soft-stop OVP voltage signal V60 from the soft-stop OVP circuit 60 rises in excess of the soft-stop OVP threshold value (the second threshold value) at a timing t11 and, after reaching the overvoltage level (the fourth threshold value), which is the threshold value at which the OVP function operation starts, at a timing t12, the soft-stop OVP voltage signal V60 fluctuates until a timing t13, at which it reaches an OVP release threshold value (a sixth threshold value) at which the OVP function operation is canceled, and the OVP function is canceled (as the sixth threshold value is higher than the second threshold value, the soft-stop OVP operation continues from the timing t13 onward also). Then, FIGS. 8B and 8C show corresponding waveforms of a multiplier gain and the inductor current $I_L$ respectively. Herein, it is the current value I64 of the constant current source 64 that determines the second threshold value. That is, the timing at which the inductor current exceeds the soft-stop OVP operation threshold value in FIG. 8A is the timing at which the overvoltage prevention current Ic exceeds the current value I64 in FIG. 7.

Herein, as the soft-stop OVP level for the soft-stop OVP voltage signal V60 is set lower than the OVP level, the gain of the multiplier 22 starts to drop at the timing t11, and the inductor current $I_L$ is curbed. As the rise of the direct current output voltage Vout is also curbed by the inductor current $I_L$ being curbed, even in the heretofore known kind of case in which the soft-stop OVP voltage signal V60 exceeds the overvoltage level (the fourth threshold value), it is possible, in the embodiment, to avoid the stopping of the switching element by arranging in such a way that the overvoltage level (the fourth threshold value) is not exceeded. Then, furthermore, even in a case in which the direct current output voltage Vout, that is, the OVP voltage signal V60, continues to increase, exceeding the overvoltage level, and the switching element is stopped, the inductor current $I_L$ is reduced to a level near zero by the time the OVP level is reached at the timing t12, and the switching operation stops, meaning that it is possible to shorten the period for which the switching element is stopped, and curb oscillation when the switching operation is stopped. Also, as the gain of the multiplier 22 is sufficiently reduced at the timing t13, at which the soft-stop OVP voltage signal V60 is reduced to the sixth threshold value at which the OVP function is cancelled, the waveform of the inductor current $I_L$ increases gently at a point at which the switching operation is restarted, and it is also possible to eliminate the squeaking at the time of restarting after stopping the switching operation. Furthermore, as the soft-stop OVP operation functions from the timing t13 onward too, and the rise of the inductor current $I_L$ and direct current output voltage Vout is curbed, it is possible to continuously prevent the occurrence of the squeaking.

Third Embodiment

In the first and second embodiments, the gain of the multiplier 22 is reduced, and the current reference signal Vmul adjusted, by increasing the current signal Iz input into the multiplier 22 with the current peak waveform generator circuit 50 and Iz generator 20*s*, or with the soft-stop OVP circuit 60.

In a third embodiment, the soft-stop OCP voltage signal V50 from the current peak waveform generator circuit 50 and the soft-stop OVP voltage signal V60 from the soft-stop OVP circuit 60 are supplied to a first input signal generator circuit (equivalent to the heretofore known Iy generator 16), and a reduced current signal Iy is generated in this current signal generator circuit, and output to the multiplier 22.

Figure 9:
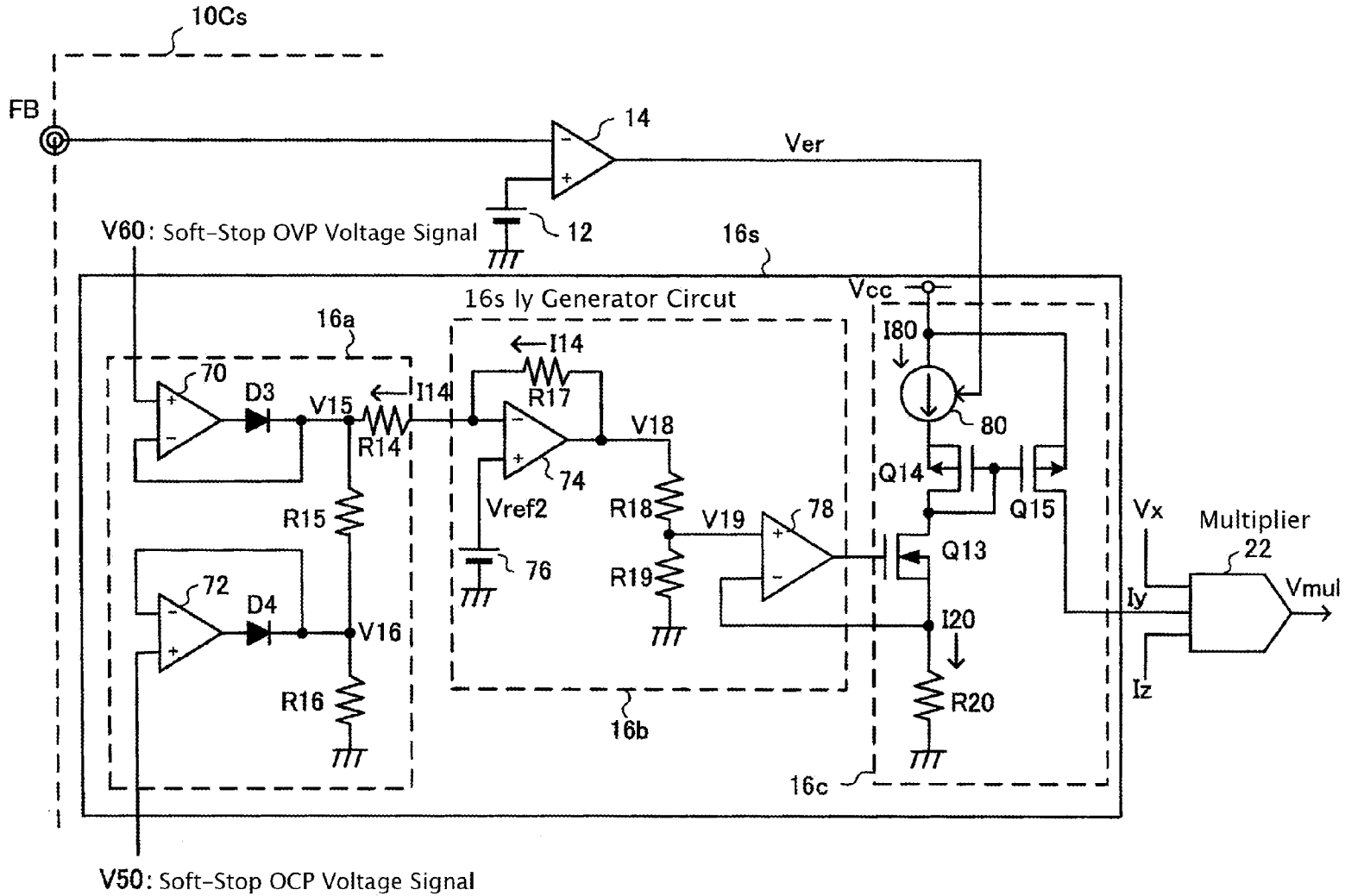
FIG. 9 is a circuit diagram showing a configuration of a first input signal generator circuit of a power factor correction control circuit in a third embodiment of the invention.

FIG. 9 is a circuit diagram showing a configuration of the first input signal generator circuit of a power factor correction control circuit 10Cs in the third embodiment of the invention.

The first input signal generator circuit (hereafter called the Iy generator 16*s*) is configured of a correction signal input portion 16*a*, a V/I conversion portion 16*b*, and a signal output portion 16*c*. The correction signal input portion 16*a* has two operational amplifiers 70 and 72 and diodes D3 and D4, and a resistor circuit of three resistors R14, R15, and R16 connected in series. The non-inversion input terminal of the operational amplifier 70 is connected to the soft-stop OVP circuit 60 shown in FIG. 7, and the soft-stop OVP voltage signal V60 is input thereinto. The output terminal of the operational amplifier 70 is connected to the inversion input terminal via the diode D3. Also, the non-inversion input terminal of the operational amplifier 72 is connected to the current peak waveform generator circuit 50 shown in FIG. 2, and the soft-stop OCP voltage signal V50 is input thereinto. The output terminal of the operational amplifier 72 is connected to the inversion input terminal via the diode D4. Furthermore, the connection point of the operational amplifier 70 inversion input terminal and diode D3 is connected to the connection point of the resistors R14 and R15 of the resistor circuit, and the connection point of the operational amplifier 72 inversion input terminal and diode D4 is connected to the connection point of the resistors R15 and R16 of the resistor circuit. One end of the resistor R16 is grounded, and one end of the resistor R14 is connected to the V/I conversion portion 16*b*.

The operational amplifier 70 and diode D3, and the operational amplifier 72 and diode D4, configure voltage followers for the soft-stop OCP voltage signal V50 and soft-stop OVP voltage signal V60 respectively. The diodes D3 and D4 are provided in order that, when the outputs of the voltage followers, that is, the soft-stop OCP voltage signal V50 and soft-stop OVP voltage signal V60, are smaller than potentials V15 and V16, to be described hereafter, the outputs of the voltage followers do not affect the potentials V15 and V16.

The V/I conversion portion 16*b* of the Iy generator 16*s* has an operational amplifier 74, a reference voltage source 76 that outputs a reference voltage Vref2, an operational amplifier 78, and three resistors R17 to R19. The inversion input terminal of the operational amplifier 74 is connected to the resistor R14 of the former stage correction signal input portion 16*a*. Also, the non-inversion input terminal of the operational amplifier 74 is connected to the reference voltage source 76, and the output terminal is connected to the inversion input terminal via the resistor R17. The output terminal of the operational amplifier 74 is grounded via the series circuit of the resistors R18 and R19, and the connection point of the resistors R18 and R19 is connected to the non-inversion input terminal of the operational amplifier 78. Herein, the operational amplifier 74, the reference voltage source 76, and the resistor R17, along with the resistors R14, R15, and R16 of the correction signal input portion 16*a*, configure an inversion amplifier circuit (the input is the potentials V15 and V16, to be described hereafter, or a ground potential).

Also, the signal output portion 16*c* of the Iy generator 16*s* has MOS transistors Q13 to Q15, a resistor R20, and a constant current source 80. The gate terminal of the MOS transistor Q13 is connected to the output terminal of the operational amplifier 78 of the V/I conversion portion 16*b*, and its drain terminal is connected to the constant current source 80 via the separate MOS transistor Q14. The source terminal of the MOS transistor Q13 is grounded via the resistor R20. Then, the connection point of the source terminal and resistor R20 is connected to the inversion input terminal of the operational amplifier 78. Also, the MOS transistors Q14 and Q15 configure a current mirror circuit, and their source terminals are connected to the constant current source 80 and the power supply terminal Vcc respectively. The constant current source 80 is connected to the power supply terminal Vcc, the voltage error signal Ver, wherein the difference between the divided voltage value of the direct current output voltage Vout and the voltage command value (the output voltage of the reference voltage source 12) is amplified, is input from the voltage error amplifier 14 as a control signal of the constant current source 80, and the constant current value of the constant current source 80 is determined. By means of this configuration, a current wherein a current I20 flowing through the resistor R20 is copied in the current mirror circuit formed by the MOS transistors Q14 and Q15 is supplied as the current signal Iy. The constant current source 80 stipulates the maximum value of the current flowing to the input side of the current mirror.

Next, a description will be given of an operation of the Iy generator 16*s*.

Herein, with regard to the potential of each portion of the Iy generator 16*s*, the potential on the resistor R19 and R18 connection point side in the V/I conversion portion 16*b* is taken to be V19, the potential on the resistor R18 and R17 connection point side to be V18, the potential on the resistor R15 and R14 connection point side in the correction signal input portion 16*a* to be V15, and the potential on the resistor R16 and R15 connection point side in the same portion to be V16.

Figures 10A, 10B, 10C:
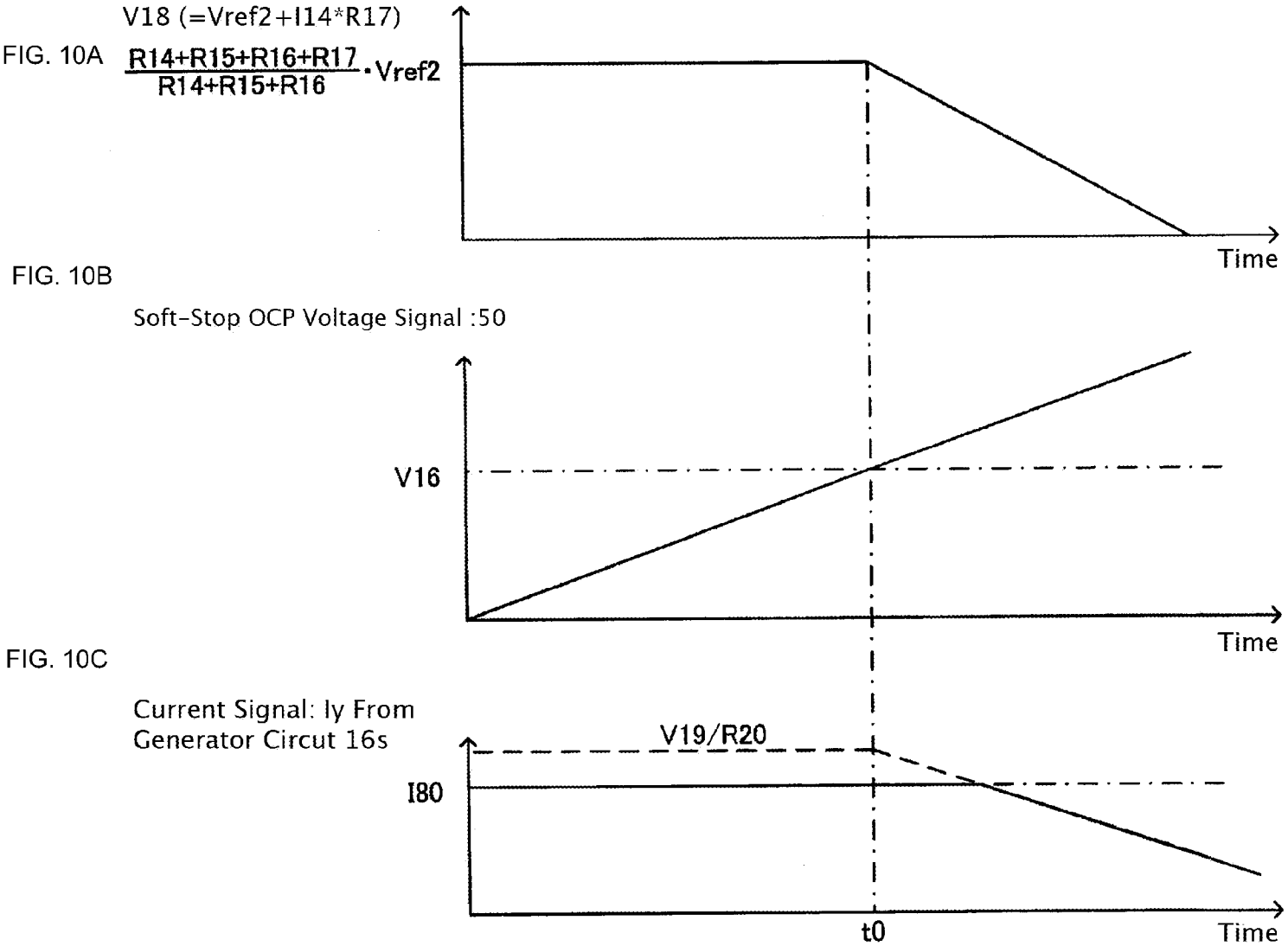
FIGS. 10A to 10C are diagrams showing a current signal Iy generated by an Iy generator of FIG. 9.

FIGS. 10A to 10C are diagrams showing the current signal Iy generated by the Iy generator 16*s* of FIG. 9.

FIG. 10A shows the potential V18 of the V/I conversion portion 16*b*, FIG. 10B shows the OCP voltage signal V50 of the current peak waveform generator circuit 50, and FIG. 10C shows the current signal Iy from the Iy generator 16*s*.

Firstly, up to a time t0, the OCP voltage signal V50 is smaller than the potential V16 (refer to FIG. 10B), and the soft-stop OVP voltage signal V60 is also smaller than the potential V15. At this time, as the two input terminals of the operational amplifier 74 in the V/I conversion portion 16*b* are in an imaginary short state, the potential of the inversion input terminal becomes the potential Vref2 of the reference voltage source 76. For this reason, a current I14 flowing toward a ground (GND) from the inversion input terminal of the operational amplifier 74 flows at a size of $$I14=Vref2/(R14+R15+R16),$$

and the following voltage value is obtained as a voltage V18 of the operational amplifier 74 output terminal side. The resistance values of each of the resistances R14 to R20 are also indicated by R14 to R20.

$$V18=Vref2+I14\times R17=Vref2\cdot(R14+R15+R16+R17)/(R14+R15+R16)$$

At this time, the voltage value V15 is of a size wherein the potential Vref of the reference voltage source 76 is divided by the resistor R14 and the series resistor of the two resistors R15 and R16, and the voltage value V16 is of a size wherein the potential Vref2 is divided by the series resistor of the resistors R14 and R15 and the resistor R13. As heretofore described, when the soft-stop OCP voltage signal V50 and soft-stop OVP voltage signal V60 are smaller than the potentials V15 and V16, due to the action of the diodes D3 and D4 of the voltage followers, the situation is equivalent to one in which the voltage followers do not exist, and this is a situation in which the soft-stop OVP function and soft-stop OCP function are not operating.

Also, the operational amplifier 78 functions in such a way that the two input terminals attain an imaginary short state and, on the imaginary short being realized, the potential of the inversion input terminal of the operational amplifier 78 becomes equivalent to the potential input into the non-inversion input terminal. Because of this, a voltage V19, wherein the voltage value V18 is divided by the resistors R18 and R19, is applied to the resistor R20 on the operational amplifier 78 inversion input terminal side, and the current I20, wherein the voltage V19 is divided by the resistance value R20, flows through the resistor R20. The current value V19/R20 stipulated by the operational amplifier 78 up to the time t0 is adjusted in such a way as to have a value equal to or higher than the maximum value of a constant current value I80 of the constant current source 80 determined by the voltage error signal Ver. In this case, the value of the current flowing to the input side of the current mirror circuit formed of the MOS transistors Q14 and Q15 up to the time t0 is the constant current value I80 of the constant current source 80, and a condition is such that the imaginary short of the two input terminals of the operational amplifier 78 is prevented by the constant current source 80 (at this time, the output of the operational amplifier 78 is pushed to the high side, and the MOS transistor Q13 attains a fully-on condition). Also, by the current mirror circuit copying the constant current I80, the current signal Iy becomes equivalent to the constant current I80.

Next, consideration will be given to a case in which either V60>V15 or V50>V16 is established for the soft-stop OVP voltage signal V60 and OCP voltage signal V50 input into the operational amplifiers 70 and 72 from the time t0 onward. Although FIGS. 10A to 10C show the case in which V50>V16, the case in which V60>V15 is the same. As the potential V15 or V16 becomes V60 or V50, becoming larger than the V15 and V16 up to the time t0, the potential difference with the potential Vref2 of the reference voltage source 76 becomes smaller, and the current I14 becomes smaller, meaning that, as shown in FIG. 10A, the voltage V18 (=Vref2+R17×I14) on the operational amplifier 74 output terminal side is reduced, and V19 and V19/R20 are also reduced in proportion thereto.

Then, the current signal Iy, which had been output at a constant value equivalent to the constant current value I80 supplied from the constant current source 80 up to the time t0, switches to the current characteristics of V19/R20 at the point at which it becomes equivalent to V19/R20, and is gradually reduced, as shown in FIG. 10C. That is, on the soft OCP voltage signal V50 or soft OVP voltage signal V60 increasing, and the soft-stop OCP function or soft-stop OVP function operating, the current signal Iy input from the Iy generator 16*s* into the multiplier 22 is reduced, because of which it is possible to reduce the current reference signal Vmul output from the multiplier 22, and curb the inductor current $I_L$.

Fourth Embodiment

Figure 11:
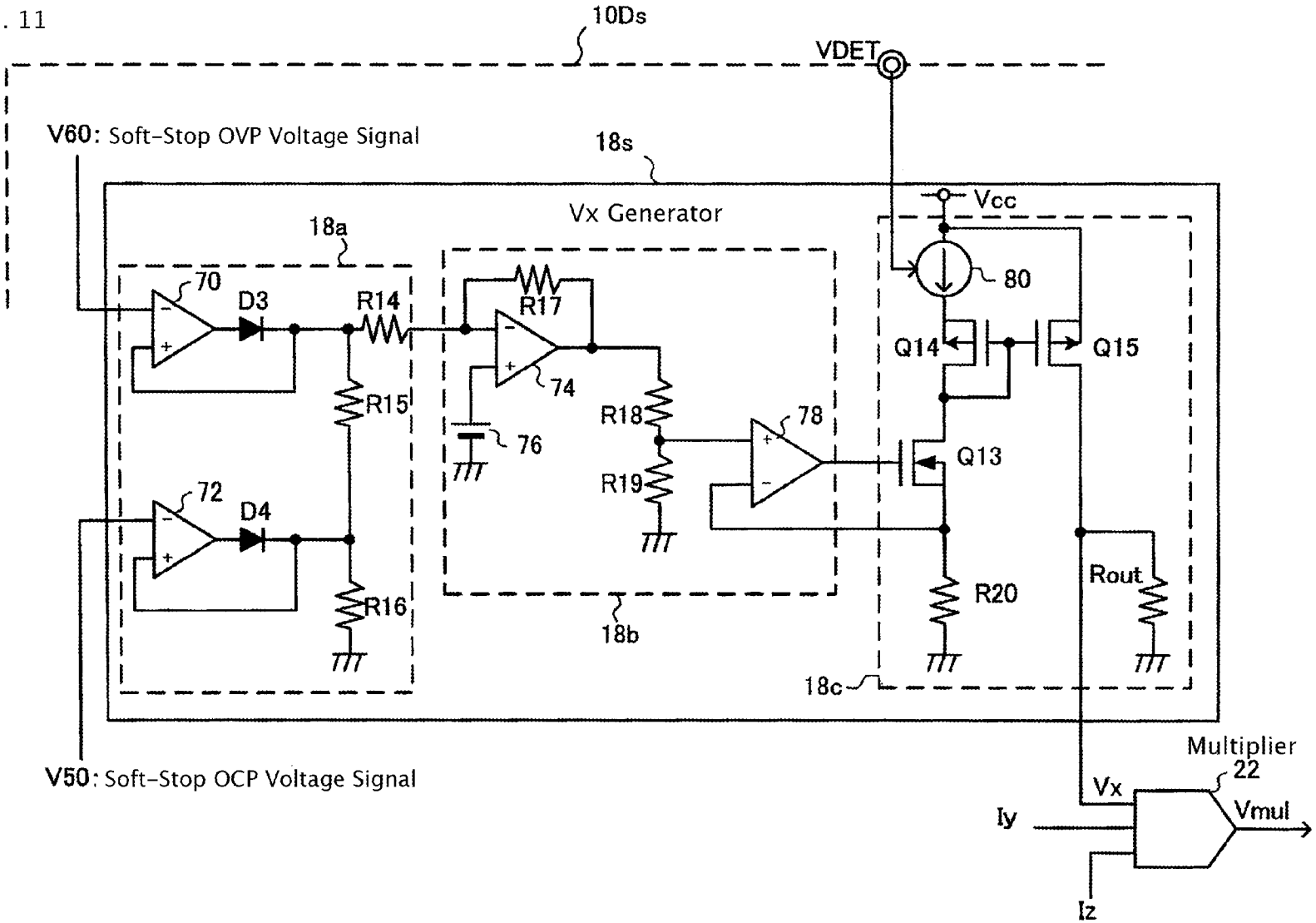
FIG. 11 is a circuit diagram showing a configuration of a second input signal generator circuit in a fourth embodiment of the invention.
Figures 12A, 12B, 12C:
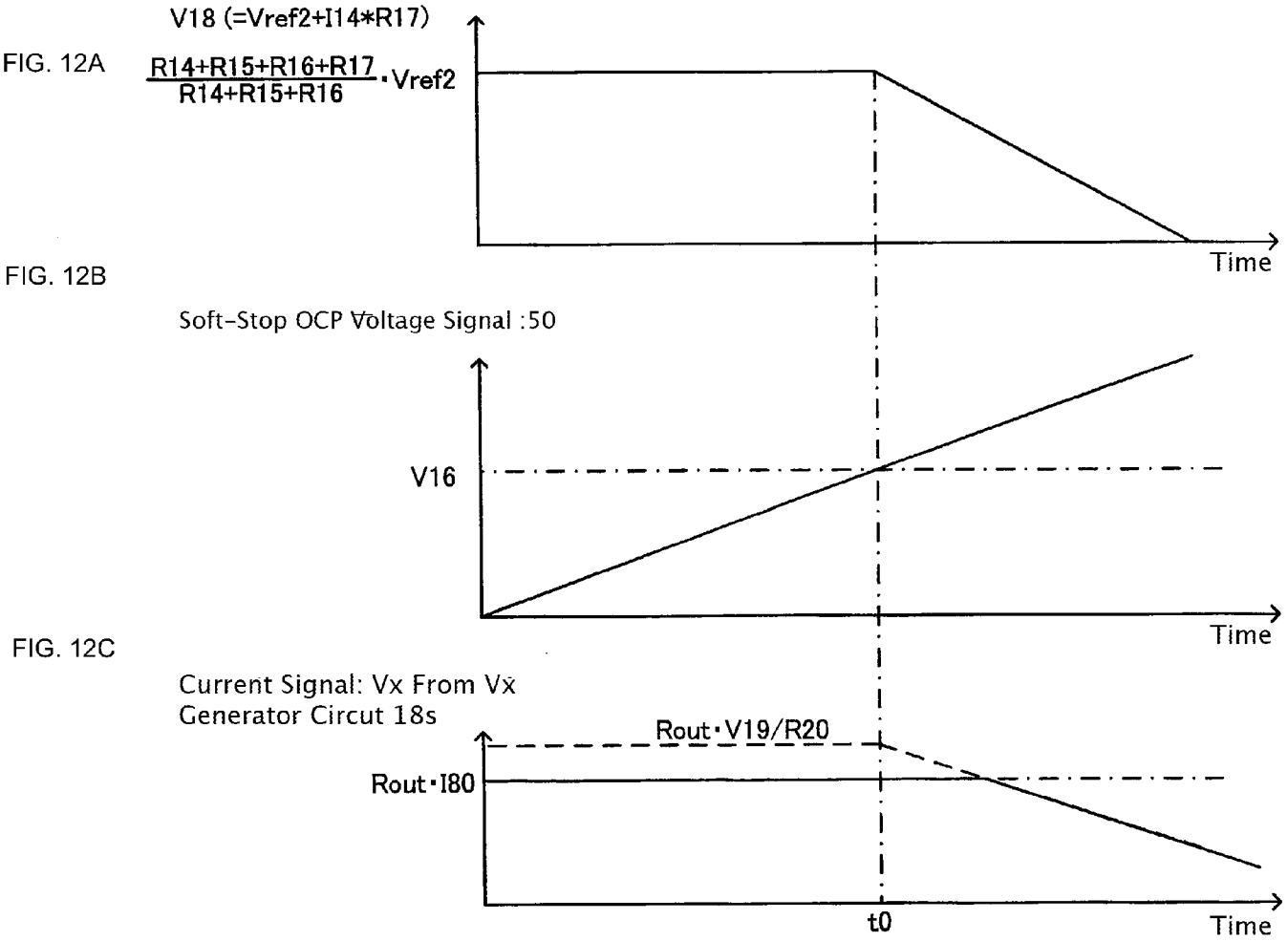
FIGS. 12A to 12C are diagrams showing a voltage signal Vx generated by a Vx generator of FIG. 11.

FIG. 11 is a circuit diagram showing a configuration of a second input signal generator circuit in a fourth embodiment of the invention, and FIGS. 12A to 12C are diagrams showing the voltage signal Vx generated by a Vx generator of FIG. 11.

In the third embodiment, a description is given of a case in which the reduced second input signal Iy is generated in the Iy generator 16*s* corresponding to the heretofore known Iy generator, and output to the multiplier 22, but with a power factor correction control circuit 10Ds of the fourth embodiment, the soft-stop OCP voltage signal V50 and soft-stop OVP voltage signal V60 from the current peak waveform generator circuit 50 or soft-stop OVP circuit 60 are supplied to the second input signal generator circuit (hereafter called the Vx generator 18*s*), and a reduced voltage signal Vx is generated.

The Vx generator 18*s* is configured of a correction signal input portion 18*a*, a V/I conversion portion 18*b*, and a signal output portion 18*c*, wherein the correction signal input portion 18*a* and V/I conversion portion 18*b* have the same configurations as the correction signal input portion 16*a* and V/I conversion portion 16*b* of the Iy generator 16*s*. Therein, the same reference numerals and characters are given to portions of the Vx generator 18*s* corresponding to the Iy generator 16*s*, and descriptions thereof will be omitted. The signal output portion 18*c* differs from the signal output portion 16*c* in that the drain terminal of the MOS transistor Q15 is grounded via a resistor Rout, and the potential of the connection point of the MOS transistor Q15 drain terminal and resistor Rout is output as the voltage signal Vx. By means of this configuration, the signal output portion 18*c* can output a voltage signal Vx proportional to the current flowing through the MOS transistor Q15.

Also, the signal output portion 18*c* differs in that the control signal to the constant current source 80 in the signal output portion 18*c* is supplied from the multiplier input terminal VDET. Consequently, in the Vx generator 18*s* too, the voltage signal Vx output from the MOS transistor Q15 source terminal becomes of a size proportional to the value of the current (I20) flowing through the resistor R20, and is output to the multiplier 22, as shown in FIG. 12C. Consequently, in the same way as in the third embodiment, on the soft-stop OCP voltage signal V50 or soft-stop OVP voltage signal V60 increasing, and the soft-stop OCP function or soft-stop OVP function operating, the voltage signal Vx input from the Vx generator 18*s* into the multiplier 22 is reduced, because of which it is possible to reduce the current reference signal Vmul output from the multiplier 22, and curb the inductor current $I_L$.

Next, a description will be given of an analog multiplier that can be used in the heretofore described power factor correction control circuits 10 (10A, 10B, 10As, 10Bs, 10Cs, and 10Ds).

Figure 13:
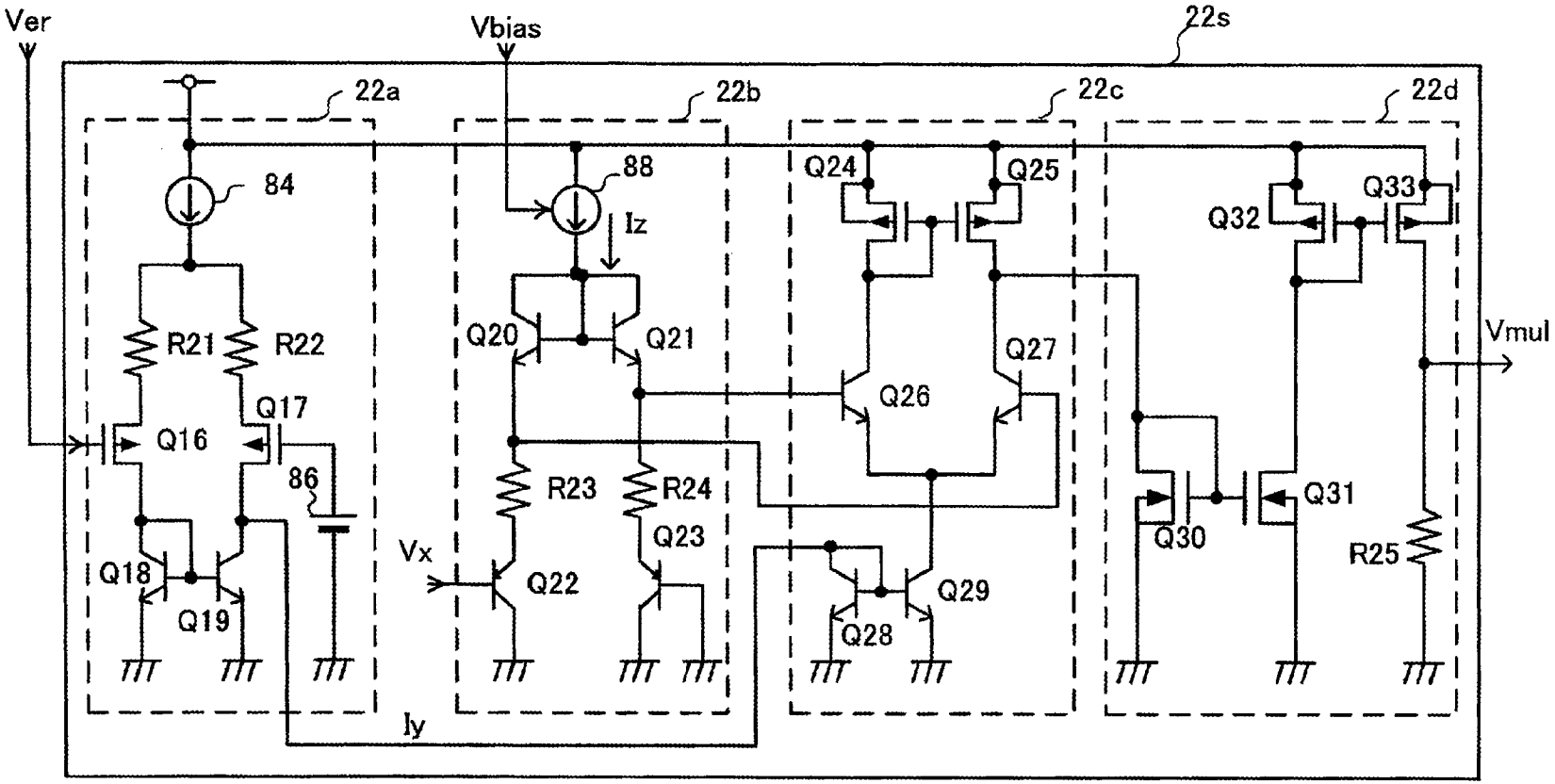
FIG. 13 is a circuit diagram showing one example of an analog multiplier including a Vx generator, an Iy generator, and an Iz generator.

FIG. 13 is a circuit diagram showing one example of an analog multiplier including a Vx generator, an Iy generator, and an Iz generator.

An analog multiplier 22*s* is configured of a V/I conversion portion 22*a*, a signal input portion 22*b*, a calculation portion 22*c*, and a signal output portion 22*d*, and outputs the voltage signal Vmul corresponding to a quotient wherein the product of the first input signal Iy and second input signal Vx is further divided by the gain adjustment current signal Iz. The V/I conversion portion 22*a* has a constant current source 84, resistors R21 and R22, MOS transistors Q16 and Q17 forming a first differential pair, a reference voltage source 86, and bipolar transistors Q18 and Q19 configuring a first current mirror circuit, and the voltage error signal Ver stipulating the first input signal Iy is input into the gate terminal of the MOS transistor Q16. This portion is a circuit corresponding to the Iy generator.

The signal input portion 22*b* has a constant current source 88, NPN type bipolar transistors Q20 and Q21 configuring a second current mirror circuit, PNP type bipolar transistors Q22 and Q23 forming a second differential pair, and resistors R23 and R24. The constant current source 88 corresponds to the Iz generator, and is configured specifically of the current peak waveform generator circuit 50 and Iz generator 20*s*, or of the soft-stop overvoltage protection circuit (soft-stop OVP circuit) 60, or the like. In the signal input portion 22*b*, a control signal corresponding to the gain adjustment current signal Iz is supplied from the constant current source 88, the second input signal Vx is input into the base terminal of the bipolar transistor Q22, and the differential output thereof is input into the calculation portion 22*c* of the next stage.

The calculation portion 22*c* has MOS transistors Q24 and Q25 configuring a third current mirror circuit, NPN type bipolar transistors Q26 and Q27 forming a third differential pair, and PNP type bipolar transistors Q28 and Q29 configuring a fourth current mirror circuit. Herein, the output current Iy of the V/I conversion portion 22*a* is input into the fourth current mirror circuit, and the differential output of the signal input portion 22*b* is input into the base terminal of the third differential pair.

The signal output portion 22*d* has MOS transistors Q30 and Q31 configuring a fifth current mirror circuit, MOS transistors Q32 and Q33 configuring a sixth current mirror circuit, and an output resistor R25. In the signal output portion 22*d*, a current signal output from the calculation portion 22*c* is supplied to the MOS transistor Q30 on the input side of the fifth current mirror circuit, and the voltage signal Vmul is output as a multiplication result from the connection point of the drain terminal of the MOS transistor Q33 on the output side of the sixth current mirror circuit and the resistor R25.

Generally, the collector current Ic stipulated by the following Equation 11 flows in the bipolar transistors.

$$Ic=Io\times\exp(Vbe/Vt) \quad 11$$

Io is a reverse collector saturation current and Vt a thermal voltage (=kT/q), both being constants, and Vbe is an inter-base emitter voltage value.

Now, in the signal input portion 22*b*, the inter-base emitter voltage values of the bipolar transistors Q20 and Q21 are V20 and V21 respectively, and the collector currents I20 and I21 respectively. An inter-emitter potential difference ΔV1 of the bipolar transistors Q20 and Q21 forming a working pair is $$\Delta V1=V21-V20 \quad 12.$$

Furthermore, when rewriting Equation 11 for Vbe, it becomes $$Vbe=Vt\times In(Ic/Io) \quad 13$$

meaning that Equation 12 can be expressed as follows.

$$\Delta V1=Vt\times In(I21/Io)-Vt\times In(I20/Io)=Vt\times In(I21/I20) \quad 14$$

In the same way, when the collector currents are I26 and I27 respectively, and the inter-base emitter voltage values V26 and V27 respectively, in the bipolar transistors Q26 and Q27 of the calculation portion 22*c*, here too, Equation 15 is established for an inter-emitter potential difference ΔV2.

$$\Delta V2=Vt\times In(I26/I27) \quad 15$$

In the bipolar transistors Q20 and Q21, and Q26 and Q27, as the inter-emitter potential differences ΔV1 and ΔV2 are equivalent, the following relationship is established between the collector currents I20 and I21, and I26 and I27.

$$(I26/I27)=(I21/I20) \quad 16$$

When a/b=c/d, as (a−b)/(a+b)=(c−d)/(c+d), Equation 16 can be rewritten as the following Equation 17.

$$(I26-I27)/(I26+I27)=(I21-I20)/(I21+I20) \quad 17$$

In the calculation portion 22*c*, the difference (=I26−I27) between the collector currents of the bipolar transistors Q26 and Q27 becomes a current output Iout to the signal output portion 22*d*. Therein, when I21+I20 is I1, I26+I27 is I2, and I21−I20 is Δi, Equation 17 can be rewritten as $$Iout=I2\times\Delta i/I1 \quad 18.$$

That is, it can be seen that the calculation portion 22*c* functions as a multiplier of I2×Δi, and also functions as a divider of I1.

Consequently, the analog multiplier 22*s* is such that the size of I2 (=I27+I26) is determined by the first input signal Iy stipulated by the voltage error signal Ver input into the V/I conversion portion 22*a*, the size of Δi (=I21−I20) is determined by the second input signal Vx applied to the base terminal of the bipolar transmitter Q22 (as the bipolar transistors Q22 and Q23 function as emitter followers, and ΔV1 (=V21−V20) is small, when this is ignored, Δi is proportional to the second input signal Vx), and the size of the gain adjustment current signal Iz, which is I1 (=I21+I20), is determined by the control signal (Vbias) in the constant current source 88 of the signal input portion 22*b*. As a result of this, the voltage signal Vmul, which is the output of the analog multiplier 22*s*, is of a size corresponding to a quotient wherein the product of the first input signal Iy and second input signal Vx is divided by the gain adjustment current signal Iz.

What is claimed is:

1. A power factor correction type switching power supply unit that, based on an alternating current input voltage full-wave rectified in a diode bridge, supplies a direct current output voltage of a step-up type converter having an inductor, a switching element, and an output capacitor to a load, the unit comprising:

a multiplier that carries out a multiplication of a voltage error signal, wherein the difference between a detected value of an output voltage and a reference voltage is amplified, and a detected value of the full-wave rectified alternating current input voltage;

a control circuit that on-off controls the switching element based on an output of the multiplier and an inductor current signal detecting an inductor current flowing through the inductor; and at least one circuit of a current peak waveform generator circuit that generates a current peak waveform signal of a waveform tracking a peak value of the inductor current signal, or a waveform similar to the tracking waveform, and a soft-stop overvoltage detection voltage generator circuit that generates a soft-stop overvoltage detection voltage proportional to the output voltage, wherein the output of the multiplier is reduced in accordance with the current peak waveform signal when the current peak waveform signal exceeds a first threshold value, or the output of the multiplier is reduced in accordance with the soft-stop overvoltage detection voltage when the soft-stop overvoltage detection voltage exceeds a second threshold value;

an overcurrent protection circuit that, a third threshold value higher than the first threshold value being set, detects that the inductor current signal has exceeded the third threshold value, and outputs an overcurrent detection signal, wherein the switching element is turned off by the overcurrent detection signal;

wherein a fifth threshold value higher than the first threshold value and lower than the third threshold value is further set in the overcurrent protection circuit and, on the inductor current signal exceeding the third threshold value and the overcurrent detection signal being output, the overcurrent detection signal continues to be output until the overcurrent detection signal reaches the fifth threshold value.

2. The power factor correction type switching power supply unit according to claim 1, wherein as the difference between the current peak waveform signal and first threshold value becomes large, the reduction amount of the output of the multiplier when the current peak waveform signal exceeds the first threshold value increases monotonically.

3. The power factor correction type switching power supply unit according to claim 1, wherein as the difference between the soft-stop overvoltage detection voltage and second threshold value becomes large, the reduction amount of the output of the multiplier when the soft-stop overvoltage detection voltage exceeds the second threshold value increases monotonically.

4. The power factor correction type switching power supply unit according to claim 1, wherein the control circuit includes:

a current error amplifier that outputs a current error signal wherein the difference between the inductor current signal and the output of the multiplier is amplified; and a PWM comparator that controls an on-off period of the switching element by pulse width modification using the current error signal.

5. A power factor correction type switching power supply unit that, based on an alternating current input voltage full-wave rectified in a diode bridge, supplies a direct current output voltage of a step-up type converter having an inductor, a switching element, and an output capacitor to a load, the unit comprising:

a multiplier that carries out a multiplication of a voltage error signal, wherein the difference between a detected value of an output voltage and a reference voltage is amplified, and a detected value of the full-wave rectified alternating current input voltage;

a control circuit that on-off controls the switching element based on an output of the multiplier and an inductor current signal detecting an inductor current flowing through the inductor; and at least one circuit of a current peak waveform generator circuit that generates a current peak waveform signal of a waveform tracking a peak value of the inductor current signal, or a waveform similar to the tracking waveform, and a soft-stop overvoltage detection voltage generator circuit that generates a soft-stop overvoltage detection voltage proportional to the output voltage, wherein the output of the multiplier is reduced in accordance with the current peak waveform signal when the current peak waveform signal exceeds a first threshold value, or the output of the multiplier is reduced in accordance with the soft-stop overvoltage detection voltage when the soft-stop overvoltage detection voltage exceeds a second threshold value;

the unit further comprising:

an overvoltage protection circuit that, a fourth threshold value higher than the second threshold value being set, detects that the soft-stop overvoltage detection voltage has exceeded the fourth threshold value, and outputs an overvoltage detection signal, wherein the switching element is turned off by the overvoltage detection signal; wherein a sixth threshold value higher than the second threshold value and lower than the fourth threshold value is set and, on it being detected that the soft-stop overvoltage detection voltage has exceeded the fourth threshold value and the overvoltage detection signal being output, the overvoltage detection signal continues to be output until the overvoltage detection signal reaches the sixth threshold value.

6. A power factor correction type switching power supply unit that, based on an alternating current input voltage full-wave rectified in a diode bridge, supplies a direct current output voltage of a step-up type converter having an inductor, a switching element, and an output capacitor to a load, the unit comprising:

a multiplier that carries out a multiplication of a voltage error signal, wherein the difference between a detected value of an output voltage and a reference voltage is amplified, and a detected value of the full-wave rectified alternating current input voltage;

a control circuit that on-off controls the switching element based on an output of the multiplier and an inductor current signal detecting an inductor current flowing through the inductor; and at least one circuit of a current peak waveform generator circuit that generates a current peak waveform signal of a waveform tracking a peak value of the inductor current signal, or a waveform similar to the tracking waveform, and a soft-stop overvoltage detection voltage generator circuit that generates a soft-stop overvoltage detection voltage proportional to the output voltage, wherein the output of the multiplier is reduced in accordance with the current peak waveform signal when the current peak waveform signal exceeds a first threshold value, or the output of the multiplier is reduced in accordance with the soft-stop overvoltage detection voltage when the soft-stop overvoltage detection voltage exceeds a second threshold value;

the unit further comprising:

a first input signal generator circuit that converts the voltage error signal into a first input signal and outputs it; and a second input signal generator circuit that converts a detected value of the alternating current input voltage into a second input signal and outputs it, wherein the multiplier carries out the multiplication using the first input signal and second input signal; wherein the first input signal is reduced, and the output of the multiplier is reduced, by supplying the current peak waveform signal to the first input signal generator circuit.

7. A power factor correction type switching power supply unit that, based on an alternating current input voltage full-wave rectified in a diode bridge, supplies a direct current output voltage of a step-up type converter having an inductor, a switching element, and an output capacitor to a load, the unit comprising:

a multiplier that carries out a multiplication of a voltage error signal, wherein the difference between a detected value of an output voltage and a reference voltage is amplified, and a detected value of the full-wave rectified alternating current input voltage;

a control circuit that on-off controls the switching element based on an output of the multiplier and an inductor current signal detecting an inductor current flowing through the inductor; and at least one circuit of a current peak waveform generator circuit that generates a current peak waveform signal of a waveform tracking a peak value of the inductor current signal, or a waveform similar to the tracking waveform, and a soft-stop overvoltage detection voltage generator circuit that generates a soft-stop overvoltage detection voltage proportional to the output voltage, wherein the output of the multiplier is reduced in accordance with the current peak waveform signal when the current peak waveform signal exceeds a first threshold value, or the output of the multiplier is reduced in accordance with the soft-stop overvoltage detection voltage when the soft-stop overvoltage detection voltage exceeds a second threshold value;

the unit further comprising:

a first input signal generator circuit that converts the voltage error signal into a first input signal and outputs it; and a second input signal generator circuit that converts a detected value of the alternating current input voltage into a second input signal and outputs it, wherein the multiplier carries out the multiplication using the first input signal and second input signal; wherein the second input signal is reduced, and the output of the multiplier is reduced, by supplying a voltage signal according to the current peak waveform signal to the second input signal generator circuit.

8. A power factor correction type switching power supply unit that, based on an alternating current input voltage full-wave rectified in a diode bridge, supplies a direct current output voltage of a step-up type converter having an inductor, a switching element, and an output capacitor to a load, the unit comprising:

a multiplier that carries out a multiplication of a voltage error signal, wherein the difference between a detected value of an output voltage and a reference voltage is amplified, and a detected value of the full-wave rectified alternating current input voltage;

a control circuit that on-off controls the switching element based on an output of the multiplier and an inductor current signal detecting an inductor current flowing through the inductor; and at least one circuit of a current peak waveform generator circuit that generates a current peak waveform signal of a waveform tracking a peak value of the inductor current signal, or a waveform similar to the tracking waveform, and a soft-stop overvoltage detection voltage generator circuit that generates a soft-stop overvoltage detection voltage proportional to the output voltage, wherein the output of the multiplier is reduced in accordance with the current peak waveform signal when the current peak waveform signal exceeds a first threshold value, or the output of the multiplier is reduced in accordance with the soft-stop overvoltage detection voltage when the soft-stop overvoltage detection voltage exceeds a second threshold value;

the unit further comprising:

a first input signal generator circuit that converts the voltage error signal into a first input signal and outputs it; and a second input signal generator circuit that converts a detected value of the alternating current input voltage into a second input signal and outputs it, wherein the multiplier carries out the multiplication using the first input signal and second input signal; wherein the multiplier has a bias current determining the gain of the multiplier, and when the current peak waveform signal exceeds the first threshold value, the bias current is changed in such a way that the gain of the multiplier is reduced further in accordance with the increase of the current peak waveform signal.

9. A power factor correction type switching power supply unit that, based on an alternating current input voltage full-wave rectified in a diode bridge, supplies a direct current output voltage of a step-up type converter having an inductor, a switching element, and an output capacitor to a load, the unit comprising:

a multiplier that carries out a multiplication of a voltage error signal, wherein the difference between a detected value of an output voltage and a reference voltage is amplified, and a detected value of the full-wave rectified alternating current input voltage;

a control circuit that on-off controls the switching element based on an output of the multiplier and an inductor current signal detecting an inductor current flowing through the inductor; and at least one circuit of a current peak waveform generator circuit that generates a current peak waveform signal of a waveform tracking a peak value of the inductor current signal, or a waveform similar to the tracking waveform, and a soft-stop overvoltage detection voltage generator circuit that generates a soft-stop overvoltage detection voltage proportional to the output voltage, wherein the output of the multiplier is reduced in accordance with the current peak waveform signal when the current peak waveform signal exceeds a first threshold value, or the output of the multiplier is reduced in accordance with the soft-stop overvoltage detection voltage when the soft-stop overvoltage detection voltage exceeds a second threshold value;

the unit further comprising:

a first input signal generator circuit that converts the voltage error signal into a first input signal and outputs it; and a second input signal generator circuit that converts a detected value of the alternating current input voltage into a second input signal and outputs it, wherein the multiplier carries out the multiplication using the first input signal and second input signal; wherein the first input signal is reduced, and the output of the multiplier is reduced, by supplying a voltage signal according to the soft-stop overvoltage detection voltage to the first input signal generator circuit.

10. A power factor correction type switching power supply unit that, based on an alternating current input voltage full-wave rectified in a diode bridge, supplies a direct current output voltage of a step-up type converter having an inductor, a switching element, and an output capacitor to a load, the unit comprising:

a multiplier that carries out a multiplication of a voltage error signal, wherein the difference between a detected value of an output voltage and a reference voltage is amplified, and a detected value of the full-wave rectified alternating current input voltage;

a control circuit that on-off controls the switching element based on an output of the multiplier and an inductor current signal detecting an inductor current flowing through the inductor; and at least one circuit of a current peak waveform generator circuit that generates a current peak waveform signal of a waveform tracking a peak value of the inductor current signal, or a waveform similar to the tracking waveform, and a soft-stop overvoltage detection voltage generator circuit that generates a soft-stop overvoltage detection voltage proportional to the output voltage, wherein the output of the multiplier is reduced in accordance with the current peak waveform signal when the current peak waveform signal exceeds a first threshold value, or the output of the multiplier is reduced in accordance with the soft-stop overvoltage detection voltage when the soft-stop overvoltage detection voltage exceeds a second threshold value;

the unit further comprising:

a first input signal generator circuit that converts the voltage error signal into a first input signal and outputs it; and a second input signal generator circuit that converts a detected value of the alternating current input voltage into a second input signal and outputs it, wherein the multiplier carries out the multiplication using the first input signal and second input signal; wherein the second input signal is reduced, and the output of the multiplier is reduced, by supplying a voltage signal according to the soft-stop overvoltage detection voltage to the second input signal generator circuit.

11. The power factor correction type switching power supply unit according to claim 10, wherein the multiplier has a bias current determining the gain of the multiplier, and when the soft-stop overvoltage detection voltage exceeds the second threshold value, the bias current is changed in such a way that the gain of the multiplier is reduced further in accordance with the increase of the soft-stop overvoltage detection voltage.

12. A power factor correction type switching power supply unit comprising:

a multiplier that carries out a multiplication of a voltage error signal and a detected value of a full-wave rectified alternating current input voltage;

a control circuit that on-off controls a switching element based on an output of the multiplier and an inductor current signal detecting an inductor current flowing through an inductor; and a current peak waveform generator circuit that generates a current peak waveform signal of a waveform tracking a peak value of the inductor current signal, or a waveform similar to the tracking waveform wherein, the output of the multiplier is reduced in accordance with the current peak waveform signal when the current peak waveform signal exceeds a first threshold value;

an overcurrent protection circuit that, a third threshold value higher than the first threshold value being set, detects that the inductor current signal has exceeded the third threshold value, and outputs an overcurrent detection signal, wherein the switching element is turned off by the overcurrent detection signal;

wherein a fifth threshold value higher than the first threshold value and lower than the third threshold value is further set in the overcurrent protection circuit and, on the inductor current signal exceeding the third threshold value and the overcurrent detection signal being output, the overcurrent detection signal continues to be output until the overcurrent detection signal reaches the fifth threshold value.

* * * * *